US012310411B2

(12) United States Patent
Steinbauer

(10) Patent No.: US 12,310,411 B2
(45) Date of Patent: May 27, 2025

(54) RIDGED MOUTHPIECE FOR AEROSOL DELIVERY DEVICES

(71) Applicant: SkyX IP Holdings I LLC, New York, NY (US)

(72) Inventor: Martin Steinbauer, New York, NY (US)

(73) Assignee: SkyX IP Holdings I LLC, New York, NY (US)

( * ) Notice: Subject to any disclaimer, the term of this patent is extended or adjusted under 35 U.S.C. 154(b) by 0 days.

(21) Appl. No.: 18/370,272

(22) Filed: Sep. 19, 2023

(65) Prior Publication Data

US 2024/0090582 A1 Mar. 21, 2024

Related U.S. Application Data

(60) Provisional application No. 63/407,849, filed on Sep. 19, 2022, provisional application No. 63/407,859, filed on Sep. 19, 2022.

(51) Int. Cl.

| | |
|---|---|
| ***A24F 40/485*** | (2020.01) |
| ***A24F 40/10*** | (2020.01) |
| *A24F 40/51* | (2020.01) |
| *A24F 40/65* | (2020.01) |
| *A24F 40/70* | (2020.01) |

(52) U.S. Cl.

CPC ..... *A24F 40/485* (2020.01); *A24F 40/10* (2020.01); *A24F 40/51* (2020.01); *A24F 40/65* (2020.01); *A24F 40/70* (2020.01)

(58) Field of Classification Search

CPC .. A24F 7/04; A24F 7/02; A24F 40/485; A24F 40/10

See application file for complete search history.

(56) References Cited

U.S. PATENT DOCUMENTS

| | | | | |
|---|---|---|---|---|
| 2,065,223 | A * | 12/1936 | Hirsch | A24F 7/00 131/228 |
| 2,696,214 | A * | 12/1954 | Swenson | A24F 7/00 131/229 |
| 9,993,025 | B2 * | 6/2018 | Alarcon | H05B 3/03 |
| 11,489,227 | B2 * | 11/2022 | Liu | A24D 3/10 |
| 2013/0199528 | A1 * | 8/2013 | Goodman | A61M 15/0091 392/394 |
| 2016/0270446 | A1 * | 9/2016 | Shenkal | H05B 3/40 |
| 2018/0020726 | A1 * | 1/2018 | Alarcon | H05B 3/03 131/329 |
| 2019/0158938 | A1 | 5/2019 | Bowen et al. | |
| 2020/0138110 | A1 * | 5/2020 | Liu | A24D 3/10 |
| 2021/0219608 | A1 | 7/2021 | Carlberg et al. | |

(Continued)

FOREIGN PATENT DOCUMENTS

| | | |
|---|---|---|
| EP | 3351122 B1 | 6/2020 |
| EP | 3298911 B1 | 8/2020 |

(Continued)

*Primary Examiner* — Hae Moon Hyeon

(74) *Attorney, Agent, or Firm* — Caldwell Intellectual Property Law

(57) ABSTRACT

This disclosure is generally directed to mouthpieces, aerosol delivery devices, and systems including mouthpieces and aerosol delivery devices. A mouthpiece includes an aerosol device attachment end, an aerosol release end, a spacer, and one or more grip surfaces. A grip surface includes a concave region including one or more ridges.

20 Claims, 13 Drawing Sheets

(56) References Cited

U.S. PATENT DOCUMENTS

| | | | |
|---|---|---|---|
| 2021/0282454 | A1 | 9/2021 | Woodcock et al. |
| 2021/0350374 | A1 | 11/2021 | Keen |
| 2022/0087319 | A1 | 3/2022 | Steinbauer et al. |
| 2022/0095698 | A1 | 3/2022 | Talbot et al. |
| 2022/0398602 | A1 | 12/2022 | Guo et al. |
| 2023/0105080 | A1 | 4/2023 | Short et al. |
| 2023/0107943 | A1 | 4/2023 | Short et al. |

FOREIGN PATENT DOCUMENTS

| | | | | |
|---|---|---|---|---|
| KR | 20200092937 | A | | 8/2020 |
| WO | WO-2019183731 | A1 | * | 10/2019 |

* cited by examiner

RIDGED MOUTHPIECE FOR AEROSOL DELIVERY DEVICES

CROSS-REFERENCE TO RELATED APPLICATIONS

This application claims the benefit of priority of U.S. Provisional Patent Application Ser. No. 63/407,849, filed on Sep. 19, 2022, and titled "RIDGED MOUTHPIECE FOR AEROSOL DELIVERY DEVICES," and U.S. Provisional Patent Application Ser. No. 63/407,859, filed on Sep. 19, 2022, and titled "NFC-BASED CONTROL SYSTEM FOR AEROSOL DELIVERY DEVICES," each of which is incorporated by reference herein in its entirety.

FIELD OF THE INVENTION

The present invention generally relates to the field of vaporizers. In particular, the present invention is directed to a ridged mouthpiece for aerosol delivery devices.

BACKGROUND

Existing vaporizers may be clunky, prone to being dropped, and prone to slipping during use. In addition, existing vaporizers may not consider the needs of users with disabilities such that these negative design factors are amplified when used by users with disabilities.

SUMMARY OF THE DISCLOSURE

In an aspect, a mouthpiece is described. The mouthpiece includes an aerosol device attachment end configured to connect to an aerosol delivery device, an aerosol release end positioned on the opposite side of the mouthpiece from the aerosol device attachment end, wherein the aerosol release end is configured to provide an aerosol to a user through one or more apertures within the aerosol release end, a top surface, wherein the top surface comprises a first concave gripping surface includes one or more top ridges, and a bottom surface, wherein the bottom surface includes a second concave gripping surface including one or more bottom ridges.

In another aspect, a system is described. The system includes an aerosol delivery device and a mouthpiece. The mouthpiece includes an aerosol device attachment end configured to connect to an aerosol delivery device, an aerosol release end positioned on the opposite side of the mouthpiece from the aerosol device attachment end, wherein the aerosol release end is configured to provide an aerosol to a user through one or more apertures within the aerosol release end, a top surface, wherein the top surface comprises a first concave gripping surface includes one or more top ridges, and a bottom surface, wherein the bottom surface includes a second concave gripping surface including one or more bottom ridges.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

Figure 1:
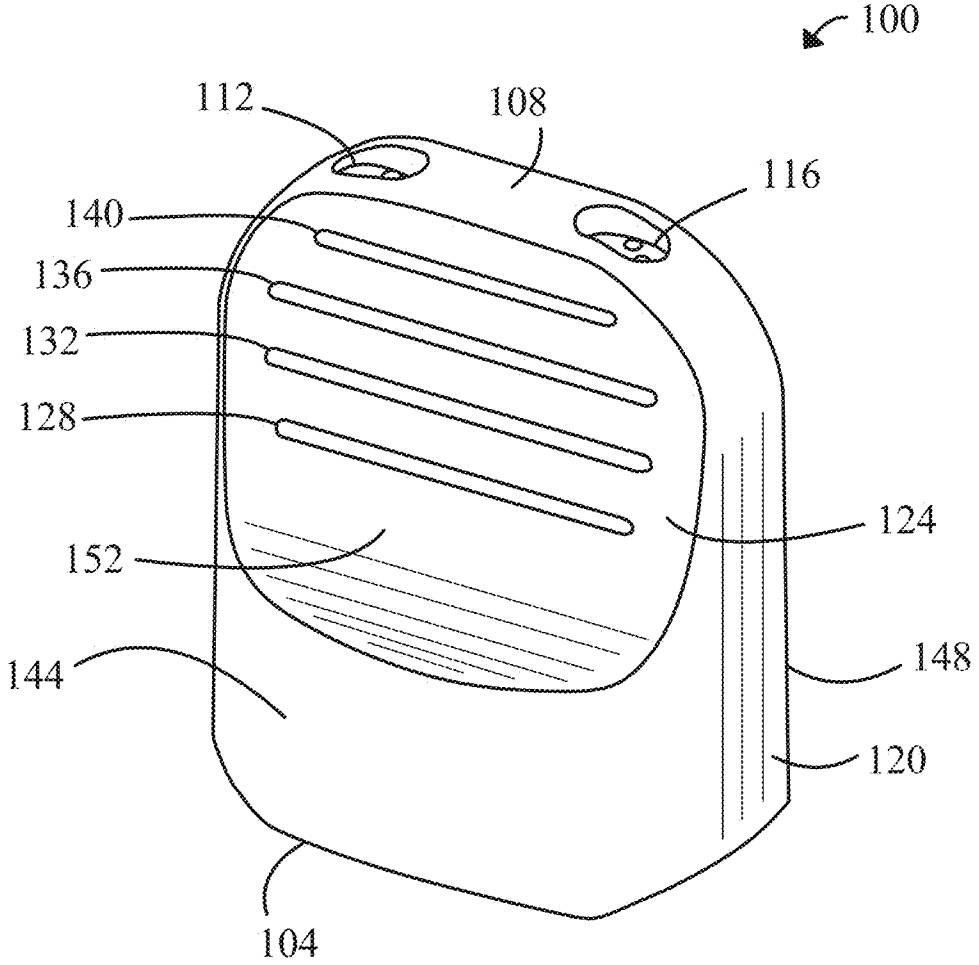
FIG. 1 depicts a side, top and back view of an exemplary mouthpiece.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, described herein is a system including an aerosol delivery device and a mouthpiece which may be attached to an aerosol delivery device. A mouthpiece may include: a first end configured to be connected to an aerosol delivery device; a second end disposed distal from the first end, where the second end is configured to provide at least one of: aerosols and oral drugs to a user through one or more apertures disposed in the second end; a first portion disposed proximate the first end and having a substantially constant cross-section; a second portion comprising a convex portion extending toward the second end; and one or more grooves disposed on the second portion, where the one or more grooves are configured to provide a grip to a user. In some embodiments, the mouthpiece is symmetrical. In some embodiments, the one or more grooves include four grooves on each side of the mouthpiece. In some embodiments, four grooves on each side of the mouthpiece are disposed in a horizontal direction relative to a plane extending from the first end to the second end of the mouthpiece.

Systems, mouthpieces, and aerosol delivery devices are described herein. A system may include a computing device. A system may include a processor. Processor may include, without limitation, any processor described in this disclosure. Processor may be included in a computing device.

Computing device may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Computing device may include a single computing device operating independently, or may include two or more computing device operating in concert, in parallel, sequentially or the like; two or more computing devices may be included together in a single computing device or in two or more computing devices. Computing device may interface or communicate with one or more additional devices as described below in further detail via a network interface device. Network interface device may be utilized for connecting computing device to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Computing device may include but is not limited to, for example, a computing device or cluster of computing devices in a first location and a second computing device or cluster of computing devices in a second location. Computing device may include one or more computing devices dedicated to data storage, security, distribution of traffic for load balancing, and the like. Computing device may distribute one or more computing tasks as described below across a plurality of computing devices of computing device, which may operate in parallel, in series, redundantly, or in any other manner used for distribution of tasks or memory between computing devices. Computing device may be implemented, as a non-limiting example, using a "shared nothing" architecture.

With continued reference to FIG. 1, computing device may be designed and/or configured to perform any method, method step, or sequence of method steps in any embodiment described in this disclosure, in any order and with any degree of repetition. For instance, computing device may be configured to perform a single step or sequence repeatedly until a desired or commanded outcome is achieved; repetition of a step or a sequence of steps may be performed iteratively and/or recursively using outputs of previous repetitions as inputs to subsequent repetitions, aggregating inputs and/or outputs of repetitions to produce an aggregate result, reduction or decrement of one or more variables such as global variables, and/or division of a larger processing task into a set of iteratively addressed smaller processing tasks. Computing device may perform any step or sequence of steps as described in this disclosure in parallel, such as simultaneously and/or substantially simultaneously performing a step two or more times using two or more parallel threads, processor cores, or the like; division of tasks between parallel threads and/or processes may be performed according to any protocol suitable for division of tasks between iterations. Persons skilled in the art, upon reviewing the entirety of this disclosure, will be aware of various ways in which steps, sequences of steps, processing tasks, and/or data may be subdivided, shared, or otherwise dealt with using iteration, recursion, and/or parallel processing.

As used herein, with respect to a mouthpiece capable of attaching to an aerosol delivery device, a "longitudinal axis" is an axis travelling from the side of the mouthpiece that attaches to the aerosol delivery device to the side of the mouthpiece farthest from the side that attaches to the aerosol delivery device. As used herein, with respect to a mouthpiece capable of attaching to an aerosol delivery device and having one or more surfaces that provides grip, a "lateral axis" is an axis perpendicular to a longitudinal axis, and travelling from a side of the mouthpiece that does not include a surface that provides grip to an opposite side of the mouthpiece that also does not include a surface that provides grip. As used herein, with respect to a mouthpiece capable of attaching to an aerosol delivery device and having one or more surfaces that provides grip, a "vertical axis" is an axis perpendicular to a longitudinal axis and perpendicular to a lateral axis. A vertical axis may travel from a side of a mouthpiece that provides grip to an opposite side of the mouthpiece, which may also provide grip.

As used herein, a first component of a mouthpiece is "forward" of a second component when the first component is closer to the side of the mouthpiece that attaches to the aerosol delivery device along a longitudinal axis. As used herein, a first component of a mouthpiece is "behind" a second component when the first component is farther from the side of the mouthpiece that attaches to the aerosol delivery device along a longitudinal axis. As used herein, the direction "left" is the left direction in FIG. 9. As used herein, the direction "right" is the right direction in FIG. 9.

Disclosed herein is an improved mouthpiece for aerosol delivery devices, such as vaporizers. A mouthpiece may include minor ridges on both sides for ease of use, grip, and hand-less holding of the device. A mouthpiece may offer assistance to users with a disability.

Now referring to FIG. 1, a view from a perspective to the top, side, and back of mouthpiece 100 is provided. As used herein, an aerosol delivery device "mouthpiece" is an element that a user may touch with their teeth, lips, or both when drawing in aerosol from an aerosol delivery device. As used herein, an "aerosol delivery device" is a device that generates aerosol such that a user may draw in the aerosol. In some embodiments, aerosol may travel from aerosol delivery device through mouthpiece 100 to a user. Mouthpiece 100 may include an aerosol delivery device attachment end 104. As used herein, an "aerosol delivery device attachment end" is an end of a mouthpiece that attaches to an aerosol delivery device. Aerosol delivery device attachment end 104 may be configured to attach to an aerosol delivery device, pod systems, disposable Electronic Nicotine Delivery Systems (ENDS), inhalers, nebulizers, and/or other oral drug delivery devices.

Still referring to FIG. 1, mouthpiece 100 may include an aerosol release end 108. Aerosol release end 108 may be positioned opposite aerosol delivery device attachment end 104. Aerosol release end 108 may contain one or more apertures, such as first aperture 112 and second aperture 116. Apertures on aerosol release end 108 may be configured to receive aerosols and/or oral drugs for delivery to a user. A user may place their mouth over the aerosol release end 108 and inhale to receive aerosols and/or oral drugs through one or more apertures. In some embodiments, one or more apertures may include a filter component. Each filter component may include a plurality of openings. In some embodiments, filter component may include 1, 2, 3, 4, 5, 6, 7, 8, 9, 10, or more openings. In some embodiments, filter component may include 4 openings.

Still referring to FIG. 1, mouthpiece 100 may include a spacer region 120. As used herein, a "spacer region" of a mouthpiece is a region of a mouthpiece that has a substantially consistent exterior along a longitudinal axis. In some embodiments, spacer regions 120 may be located forward of a gripping surface and behind an aerosol device attachment end along a longitudinal axis. In some embodiments, spacer regions 120 may have a substantially consistent cross section when travelling along a longitudinal axis.

Still referring to FIG. 1, in some embodiments, mouthpiece 100 may include a gripping surface 124. As used herein, a mouthpiece "gripping surface" is a surface of a mouthpiece that provides grip to a user drawing aerosol from an aerosol delivery device. Gripping surface 124 may include a concave, convex, scalloped, and/or tapered region. In some embodiments, gripping surface 124 is not convex. In some embodiments, gripping surface 124 may be flat, sloped, wavy, irregular, or the like.

Still referring to FIG. 1, in some embodiments, gripping surface 124 may contain one or more grooves and/or ridges. Gripping surface 124 may include first ridge 128, second ridge 132, third ridge 136, and fourth ridge 140. In some embodiments, ridges and/or grooves may be parallel. In some embodiments, ridges and/or grooves may run along a lateral axis. In some embodiments, ridges and/or grooves may be equal distances apart. In some embodiments, mouthpiece 100 may include a first gripping surface on top surface 144 and a second gripping surface on bottom surface 148. In some embodiments, a top gripping surface and a bottom gripping surface may share features such as number of grooves and/or ridges, their position, and their length. In some embodiments, top surface 144 and bottom surface 148 may be symmetrical. In some embodiments, each groove may have a substantially similar and/or identical depth. In some embodiments, each ridge may have a substantially similar and/or identical height.

Still referring to FIG. 1, in some embodiments, ridges may have different lengths. In one embodiment, first ridge 128 and fourth ridge 140 may have a same or similar length and second ridge 132 and third ridge 136 may have a same or similar length. The lengths of second ridge 132 and third ridge 136 may be longer than the lengths of first ridge 128 and fourth ridge 140. In some embodiments, fourth ridge 140 may be shorter than first ridge 128, second ridge 132, and third ridge 136. In some embodiments, first ridge 128 may be shorter than second ridge 132 and third ridge 136. In some embodiments, second ridge 132 and third ridge 136 may have substantially equal length.

Still referring to FIG. 1, in some embodiments, there is a need for better user control of inhalation from a vaporizer device. The addition of the ridges 128, 132, 136, and 140 on mouthpiece 100 provides users with an additional sensorial cue for repeatability during use. Users may want to use their vaporizer or inhaler devices hands-free. Added friction from ridges 128, 132, 136, and 140 stabilizes the device during use, which may enable the user to utilize the device hands-free. Added friction from the grooves 128, 132, 136, and 140 prevents slippage during use as well as during storage or travel. Added grip may cause a user to be less likely to drop the device, reducing the risk of contamination and fracture.

Still referring to FIG. 1, in some embodiments, mouthpiece 100 may include smooth surface 152 forward of one or more top ridges. Smooth surface 152 may be longer in a longitudinal direction than the distance between two adjacent ridges of the one or more top ridges. Smooth surface 152 may be included within a concave surface. In some embodiments, mouthpiece 100 lacks a similar smooth surface behind a set of ridges. For example, a distance between two adjacent ridges of the one or more top ridges may be at least as long as the distance between the rearmost ridge of a set of ridges and aerosol release end 108.

Still referring to FIG. 1, people with disabilities may benefit from an accessible design that enables and maximizes hands-free use on inhalable medication devices such as inhalers or nebulizers, or even inhalable consumer products such as nicotine vaporizers. Ridges 128, 132, 136, and 140 may allow these devices to be more readily accessible to disabled users.

Still referring to FIG. 1, the functionality of the mouthpiece 100 may provide a better grip for the user, enabling a hands-free experience through added friction on the mouthpiece. Optimized suction repeatability through an added cue of roughness provides a sensorial reminder of previous handling. This can help to select and maintain preferred airflow for each user.

Still referring to FIG. 1, in some embodiments, mouthpiece 100 may have a glossy outer appearance. In some embodiments, mouthpiece 100 may be made from a thermoplastic polymer, such as Bisphenol A (BPA)-free polycarbonate and/or acrylonitrile butadiene styrene (ABS). As used herein, a "thermoplastic polymer" is a plastic polymer material that becomes pliable or moldable at a certain elevated temperature and solidifies upon cooling. In another embodiment, mouthpiece 100 may be made from metal, plastic, wood, a combination of materials, or the like. Mouthpiece 100 may be made using a method described for production of outer body of aerosol delivery device. Non-limiting examples of materials which may be used include BIOGRADE B-M, BIOPAR FG MO, BIOPLAST, ENSO RENEW RTP, Polyethylene Terephthalate, High-Density Polyethylene, Polypropylene, and the like. In some embodiments, one or more ridges may be made from a different material than other surfaces of mouthpiece 100 and/or aerosol delivery device 204. In some embodiments, gripping surface 124 may be made from a different surface than other surfaces of mouthpiece 100 and/or aerosol delivery device 204. For example, gripping surface 124 may be made from a material that is more durable, more comfortable and/or safer than a material used to make spacer region 120 and/or outer body 208. In some embodiments, ridges of mouthpiece 100, such as ridges 128, 132, 136, and 140, may include a rubber material. In some embodiments, rubber may include Neoprene, Nitrile, and/or Silicone rubber. In some embodiments, rubber may include a food-grade or food-safe rubber. Mouthpiece 100 may be made using materials described for makeup of outer body of aerosol delivery device.

Figure 2:
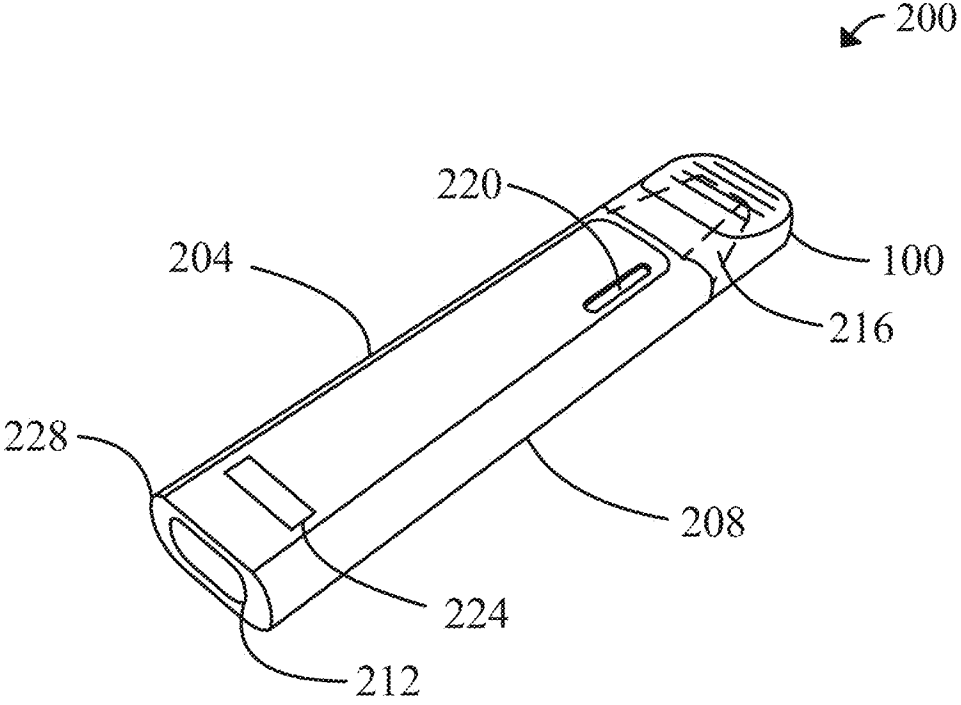
FIG. 2 depicts a side, top and front view of an exemplary system including an aerosol delivery device and a mouthpiece.

Referring now to FIG. 1 and FIG. 2, in some embodiments, mouthpiece 100 may be hollow. In some embodiments, mouthpiece 100 may include a concave section on aerosol delivery device attachment end 104; this may allow room for a component of aerosol delivery device 204, such as aerosolizable material reservoir 216, to fit into mouthpiece 100. As used in this disclosure, an "aerosolizable material reservoir" is a component of apparatus 100 configured to hold an aerosolizable material. "Aerosolizable material," for the purpose of this disclosure, is a material that is capable for aerosolization, wherein the aerosolization is a process of intentionally oxidatively converting and suspending particles or a composition in a moving stream of air. In some embodiments, mouthpiece 100 may include a channel connecting a port on aerosol delivery device attachment end 104 to one or more apertures, such as first aperture 112 and/or second aperture 116 on aerosol release end 108. Such a port may connect with a port on aerosol delivery device 204, such as a port on a back end of aerosol delivery device 204, through which aerosol may travel. Such port on aerosol delivery device 204 may connect with an aerosol generation mechanism 228 and/or air inlet 212. For example, such port on aerosol delivery device 204 may connect with an aerosol generation mechanism 228 and/or air inlet 212 using a friction fit, threaded connection, adhesive, snapping tabs that hold mouthpiece 100 in place, and the like. One or more components of mouthpiece 100 and/or aerosol delivery device 204, such as an internal component of mouthpiece 100, may be consistent with any such component of U.S. patent application Ser. No. 17/499,326, filed on Oct. 12, 2021, and titled "VAPORIZER CARTRIDGE," the entirety of which is hereby incorporated by reference.

Referring now to FIG. 2, an exemplary embodiment of a system 200 for aerosol delivery is illustrated. System 200 may include aerosol delivery device 204. Aerosol delivery device 204 may include, for example, a pod system, a disposable ENDS, an inhaler, a nebulizer, and/or an oral drug delivery device. Aerosol delivery device 204 may include outer body 208. As used in this disclosure, an "outer body" is a container configured to encapsulate one or more internal elements. Internal elements may include, in non-limiting examples, aerosol generation mechanism, battery, control circuit, and aerosolizable material reservoir. Outer body 208 may include any suitable material or combination of materials. For instance, and without limitation, outer body 208 may include metal, such as without limitation aluminum, steel, or the like. Outer body 208 may include plastic, such as without limitation polyvinyl chloride (PVC), high-density polyethylene (HDPE), acrylonitrile butadiene styrene (ABS), or the like. Outer body 208 may include ceramic. Outer body 208 may include composite material; as a non-limiting example, outer body 208 may include fiberglass or hemp fiber.

Still referring to FIG. 2, outer body 208 may be manufactured according to any suitable method or combination of methods, including without limitation casting, molding, subtractive processes such as machining, computer numerical control (CNC) machining, or the like, additive processes such as fused deposition printing, power-binder printing, selective laser sintering, stereolithography, or the like, lamination, coating, finishing, painting, polishing, engraving, anodization, assembly of parts through adhesion, engineering fits, fastening, fusing, or the like, or any combination thereof. Persons skilled in the art, upon reviewing the entirety of this disclosure, will be aware of various materials and/or material components usable to construct outer body 208 or other elements, components, and/or devices of system 200, as well as suitable methods or combinations of methods for manufacturing outer body 208, components of outer body 208, and/or any other elements, components, and/or devices of system 200 as consistent with the instant disclosure.

Still referring to FIG. 2, system 200 may include a power source. As used herein, a "power source" is an element configured to provide electric power to a circuit, device, or both. In some cases, a power source may be connected to a plurality of electronic device or components such as, without limitation, processing circuit, control circuit, and/or any computing device described herein. A power source may include, without limitation, a battery containing one or more cell chemistries such as, without limitation, lithium cobalt oxide (LCO), lithium nickel cobalt aluminum oxide (NCA), lithium nickel manganese cobalt oxide (NMC), lithium iron phosphate (LFP), and the like; a power source may be rechargeable. In some embodiments, a power source may be configured to transmit electric power to elements, components, and/or devices within system 200 which require electricity to operate, such as, without limitation, processing circuit, control circuit, and/or any computing device described herein. In some cases, transmitting electric power may include using one or more continuous conductors. As used in this disclosure, a "continuous conductor" is an electrical conductor, without any interruption, made from electrically conducting material that is capable of carrying electrical current. Electrically conductive material may comprise, for example, copper. Electrically conductive material may include any material that is conductive to electrical current and may include, as a nonlimiting example, various metals such as copper, steel, or aluminum, carbon conducting materials, or any other suitable conductive material. In a non-limiting example, a power source may transmit electric power through a continuous conductive wire to control circuit and/or processing circuit. Additionally, or alternatively, a power source may be integrated and/or embedded within control circuit and/or processing circuit. In a non-limiting example, control circuit and/or processing circuit may be supplied by separate power sources. In other embodiments, a control circuit and/or a processing circuit may share a common power source. In a non-limiting example, a power source may be remote to control circuit and/or processing circuit and transmit electric power through one or more continuous conductor to control circuit and/or processing circuit over a distance within system 200.

Still referring to FIG. 2, system 200 may include an aerosolizable material reservoir. As used in this disclosure, an "aerosolizable material reservoir" is a component configured to hold an aerosolizable material. "Aerosolizable material," for the purpose of this disclosure, is a material that is capable for aerosolization, where aerosolization is a process of intentionally oxidatively converting and suspending particles or a composition in a moving stream of air. Aerosolizable material may include one or more active ingredients and/or chemicals, including without limitation pharmaceutical chemicals, recreational chemicals, flavor-bearing chemicals, and the like. Chemicals may be extracted, without limitation, from plant material, and/or a botanical, such as tobacco or other herbs or blends. Chemicals may be in pure form and/or in combination or mixture with humectants that may or may not be mixed with plant material. In a non-limiting example, aerosolizable material may include E-cigarette liquid, wherein the E-cigarette liquid is a liquid solution or mixture used in aerosol delivery device such as, without limitation, an e-cigarette. In some cases, aerosolizable material may include a humectant. As used herein, a "humectant" is a substance used to keep things moist. Humectant may attract and retain moisture in the air by absorption, allowing the water to be used by other substances. Humectants are also commonly used in many tobaccos or botanicals and electronic vaporization products to keep products moist and as vapor-forming medium. Examples may include, without limitation, propylene glycol, sugar polyols such as glycerol, glycerin, honey and the like thereof. Continuing the non-limiting example, E-cigarette liquid may consist a combination of propylene glycol and glycerin (95%), and flavorings, nicotine, and other additives (5%). In some embodiments, aerosolizable material held by an aerosolizable material reservoir may be replaceable. In a non-limiting example, aerosolizable material reservoir may include a secondary container such as a liquid chamber, wherein the liquid chamber may contain a single type of aerosolizable material. Liquid chamber may be inserted into aerosolizable material reservoir; in other words, aerosolizable material may not be in direct contact with aerosolizable material reservoir. A user of system 200 may switch from a first aerosolizable material to a second aerosolizable material by ejecting a first liquid chamber storing the first aerosolizable material from an aerosolizable material reservoir and inserting a second liquid chamber storing a second aerosolizable material into the aerosolizable material reservoir.

Still referring to FIG. 2, system 200 may include a control circuit. As used herein, a "control circuit" is a circuit configured to control a status of a component of an aerosol delivery device. A control circuit may be implemented, without limitation, as an application-specific integrated circuit (ASIC), a reconfigurable hardware circuit such as a field-programmable gate array (FPGA), as a microprocessor, microcontroller, an analog circuit such as without limitation an operational amplifier circuit, or as any other circuit capable of generating signals as described in further detail below. In some embodiments, without limitation, a control circuit may be further configured to control other elements, components, and/or devices within system 200. A control circuit may include an aerosol generation mechanism. For instance, and without limitation, a control circuit may be configured to direct, control, or otherwise regulate the output of electric power from a power source through a continuous conductor to other components of system 200 that require electric power input such as, without limitation, an aerosol generation mechanism.

Still referring to FIG. 2, as used herein, an "aerosol generation mechanism" is a component on an aerosol delivery device configured to generate aerosol using an aerosolizable material. In an embodiment, aerosol generation mechanism may be configured to convert an aerosolizable material into a vapor. As used herein, "vapor" is a substance that is in a gas phase or that is suspended in a gas. The vapor may be condensed to a liquid or to a solid by increasing its pressure without reducing the temperature. Vapor may include an aerosol. As used herein, an "aerosol" is a colloid of fine solid particles or liquid droplets in air or another gas. Examples of aerosols may include clouds, haze, and smoke, including the smoke from tobacco or botanical products. The liquid or solid particles in an aerosol may have varying diameters of average mass that may range from monodisperse aerosols, producible in the laboratory, and containing particles of uniform size; to polydisperse colloidal systems, exhibiting a range of particle sizes. As the sizes of these particles become larger, they have a greater settling speed which causes them to settle out of the aerosol faster, making the appearance of the aerosol less dense and to shorten the time in which the aerosol will linger in air. Interestingly, an aerosol with smaller particles will appear thicker or denser because it has more particles. Particle number has a much bigger impact on light scattering than particle size (at least for the considered ranges of particle size), thus allowing for a vapor cloud with more smaller particles to appear denser than a cloud having fewer, but larger particle sizes.

Still referring to FIG. 2, in some embodiments, an aerosol generation mechanism may include various internal elements, including without limitation, a heating element, which may include a resistive heater configured to thermally contact the aerosolizable material from an aerosolizable material reservoir. A power source controlled by a control circuit, as described above, may provide electricity to a heating element. In a non-limiting example, using a heating element of an aerosol generation mechanism for vaporization of an aerosolizable material may be used as an alternative to burning (smoking) which may avoid inhalation of many irritating and/or toxic carcinogenic by-products which may result from pyrolytic processes of burning material such as, without limitation, tobacco or botanical products above 300 degrees C. Heating element may operate at a temperature at/or below 300 degrees C., configured by an aerosol generation mechanism, controlled by a control circuit.

Still referring to FIG. 2, an aerosol generation mechanism may include an atomizer and/or cartomizer configured to heat aerosolizable material. As used in this disclosure, an "atomizer" is a device for emitting liquid as a fine spray. Such a liquid may include aerosolizable material. Aerosolizable material may include any aerosolizable material described herein; for instance, and without limitation, aerosolizable material may comprise glycerin and/or propylene glycol. Aerosolizable material may be heated, by heating element described above, to a sufficient temperature such that it may vaporize. Atomizer may include a device or system configured to generate an aerosol. An atomizer may include, without limitation, a small heating element that heats and/or vaporizes at least a portion of aerosolizable material and a wicking material that may draw a liquid aerosolizable material in to the atomizer; a wicking material may comprise silica fibers, cotton, ceramic, hemp, stainless steel mesh, and/or rope cables. A wicking material may be designed and/or configured to draw liquid aerosolizable material into atomizer without a pump or other mechanical moving part. A resistance wire may be wrapped around a wicking material and then connected to a positive and negative pole of a current source such as a power source as noted above; a resistance wire may include, without limitation, a coil, and when activated may have a temperature increase as a result of the current flowing through the resistive wire to generate heat. Heat may be transferred from heating element to aerosolizable material through conductive, convective, and/or radiative heat transfer such that aerosolizable material vaporizes.

Still referring to FIG. 2, as an alternative or additional element to an atomizer, an aerosol generation mechanism may include a cartomizer to generate aerosol from aerosolizable material for inhalation by the user of system 200. As used in this disclosure, a "cartomizer" is a combination of an atomizer and a cartridge that holds aerosolizable material. As a non-limiting example, a cartridge may include an aerosolizable material reservoir. A cartomizer may include a heating element surrounded by a liquid-soaked poly-foam that acts as holder for aerosolizable material, which may include without limitation a liquid. In some embodiments, an aerosol generation mechanism may lack an atomizer or cartomizer, but may include an oven instead, which may be at least partially closed. An "oven," for the purpose of this disclosure, is a component configured to heat confined substances, such as, without limitation, aerosolizable material. Oven may have a closable opening. Oven may be wrapped with heating element or may be in thermal communication with a heating element by means of another mechanism. Aerosolizable material may be placed directly in an oven or in a liquid chamber fitted in the oven. A heating element in thermal communication with the oven may heat aerosolizable material mass in order to create a gas phase vapor, including without limitation through conductive, convective, and/or radiative heat transfer. Vapor may be released to a vaporization chamber where gas phase vapor may condense, forming an aerosol cloud having typical liquid vapor particles with particles having a diameter of average mass of approximately 1 micron or greater. In some cases, the diameter of average mass may be approximately 0.1-1 micron.

Still referring to FIG. 2, air may be drawn into an aerosol generation mechanism to carry vaporized aerosol away from a heating element, where it then cools and condenses to form liquid particles suspended in air, which may then be drawn out of a mouthpiece by the user. In a non-limiting example, a system may include inlet 212. Inlet 212 may include a hole or passage that allows air to pass into aerosol delivery device 204. In some embodiments, fresh air may be allowed to enter system 200 through inlet 212 when a heating element is on. Vaporization of aerosolizable material may occur at lower temperatures in aerosol generation mechanism compared to temperatures required to generate an inhalable vapor in a cigarette. The lower temperature of an aerosol generation mechanism may result in less decomposition and/or reaction of aerosolizable material, and therefore produce an aerosol with fewer chemical components compared to a cigarette. In some cases, aerosol generation mechanism may generate aerosol with fewer chemical components that may be harmful to human health compared to a cigarette.

Still referring to FIG. 2, system 200 may include a processing circuit. As used in this disclosure, a "processing circuit" is a circuit configured to perform processing and/or memory functions. In a non-limiting example, processing circuit may be configured to process any processing steps described in this disclosure. Processing circuit may include any computing device as described in this disclosure, including without limitation a microcontroller, microprocessor, digital signal processor (DSP) and/or system on a chip (SoC) as described in this disclosure. Computing device may include, be included in, and/or communicate with a mobile device such as a mobile telephone or smartphone. Processing circuit may include a single computing device operating independently, or may include two or more computing device operating in concert, in parallel, sequentially or the like; two or more computing devices may be included together in a single computing device or in two or more computing devices. Processing circuit may interface or communicate with one or more additional devices as described below in further detail via a network interface device. Network interface device may be utilized for connecting processing circuit to one or more of a variety of networks, and one or more devices. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network may employ a wired and/or a wireless mode of communication. In general, any network topology may be used. Information (e.g., data, software etc.) may be communicated to and/or from a computer and/or a computing device. Processing circuit may include but is not limited to, for example, a computing device or cluster of computing devices in a first location and a second computing device or cluster of computing devices in a second location. Processing circuit may include one or more computing devices dedicated to data storage, security, distribution of traffic for load balancing, and the like. Processing circuit may distribute one or more computing tasks as described below across a plurality of computing devices of computing device, which may operate in parallel, in series, redundantly, or in any other manner used for distribution of tasks or memory between computing devices. Processing circuit may be implemented using a "shared nothing" architecture in which data is cached at the worker, in an embodiment, this may enable scalability of system 200 and/or computing device.

Still referring to FIG. 2, aerosol delivery device 204 may include components such as a control circuit and/or processing circuit which may, for example, control use of aerosol delivery device. A system, aerosol delivery device, mouthpiece, and/or component of system, aerosol delivery device and/or mouthpiece may be consistent with any such system, aerosol delivery device, component, or mouthpiece disclosed in U.S. patent application Ser. No. 18/211,706, filed on Jun. 20, 2023, and titled "APPARATUS AND METHOD FOR AEROSOL DELIVERY," the entirety of which is hereby incorporated by reference.

Still referring to FIG. 2, outer body 208 may encapsulate internal components of aerosol delivery device 204, such as, without limitation, power source, aerosolizable material reservoir, control circuit, aerosol generation mechanism, processing circuit, and the like. Outer body 208 may take on a variety of shapes. In some embodiments, outer body 208 may include a cylinder. In some embodiments, outer body 208 may include a cylinder with 2 flat sides and 2 rounded sides. In some embodiments, outer body may slightly taper towards the side to which mouthpiece 100 attaches. In a non-limiting example, outer body 208 may be designed in a shape comparable to an actual cigarette. In some embodiments, outer body 208 may be detachable from mouthpiece 100. In some embodiments, one or more components of system 200 and/or aerosol delivery device 204 may be detachable from outer body 208. In a non-limiting example, outer body 208 may be detachable from a cartridge, where a cartridge may include one or more internal elements, components, and/or devices listed above. System 200 may include a mouthpiece 100 at a back end of outer body 208. In some embodiments, mouthpiece 100 may be located on an opposite end to front end. Mouthpiece 100 may include an element of apparatus 100 through which a user inhales vapor. In some embodiments, mouthpiece 100 may include one or more apertures through which vapor may be drawn when a user inhales, a passage through which vapor passes to the aperture, one or more inlets to permit passage of air through mouthpiece 100, and/or any other suitable feature. Mouthpiece 100 may be tapered or otherwise shaped to fit in a user's mouth with ease and comfort.

Still referring to FIG. 2, in a non-limiting example, front end of outer body 208 may include charging connector, which may include a circuit or circuit element by means of which electric power may be transferred from an external power source to a power source of system 200. For instance, and without limitation, charging connector may include an inductive charging coil whereby electrical power is transferred to the inductive charging coil using a varying exterior magnetic field supplied by another device or a conductive connection from system 200 to an exterior device. A non-limiting example of a conductive connection may include two or more charge contacts, which may be constructed of conductive material and accessible from an exterior surface of outer body 208, such as, without limitation, front end. Charge contacts may be in electrical communication with a power source inside of outer body 208; charge contact pins may be visible on the exterior of outer body 208. When system 200 is connected to an external power source, charging pins may facilitate electrical communication between a power source inside system 200 and an external power source. Charging pins may be electrically connected to a power source of system 200 via any suitable connection; for instance, and without limitation, charging pins may contact one or more conductive elements including springs, clips, and/or a printed circuit board (PCB). Charging pins may include male and/or female connectors; for instance, charging pins may include a "plug" that projects from front end and/or back end of outer body 208 or may include holes into which a plug or one or more projecting conducting pins may be inserted. Additionally, or alternatively, charging connector on back end may include a magnetic contact.

Still referring to FIG. 2, outer body 208 may include an end-cap. As used in this disclosure, an "end-cap" is a removable cover element that covers an end of an outer body. In a non-limiting example, an end-cap may close off mouthpiece 100. An end-cap may be attached to outer body 208 in any suitable manner, including without limitation a press-fit, snap fit, adhesion, fusion, fastening, or the like; end-cap may be formed as an integral portion of outer body 208.

Still referring to FIG. 2, in some embodiments, a status indicator 220 may be located on a surface of outer body 208. As used in this disclosure, a "status indicator" is an element that continuously indicates a status of an aerosol delivery device, a mouthpiece, a component of an aerosol delivery device, a component of a mouthpiece, or a combination of these elements. A status of system 200 may include, without limitation, an internal state of a processing circuit, a state of a power source, a state of an aerosol generation mechanism and the like. In some embodiments, a status indicator 220 may include a passive status indicator, wherein the passive status indicator may be a status indicator 220 with physical configurations on outer body 208 which enables one or more indications of current apparatus state. In a non-limiting example, passive status indicator may be located on a surface of outer body 208 where at least a portion of the surface is transparent and/or hollow. User may observe elements, components, or otherwise devices inside outer body 208 through such a portion of the surface to know a status of system 200. For instance, and without limitation, status indicator 220 may include a liquid fill level indicator, wherein the liquid fill level indicator may passively allow user to acknowledge the amount of aerosolizable material remaining within an aerosolizable material reservoir, using a liquid fill level indicator on the surface of outer body 208 that right above aerosolizable material reservoir. In other embodiments, status indicator 220 may include an active status indicator, wherein the active status indicator may be a status indicator 220 with electrical configurations inside outer body 208 which enables one or more indications of current apparatus state. In a non-limiting example, active status indicator may include an indicator light located on outer body 208. Indicator light may include any light-emitting electronic component, including without limitation a light-emitting diode (LED). Continuing the non-limiting example, liquid fill level indicator may include a LED configured to indicate a detected liquid fill level of aerosolizable material reservoir by illuminating various color of lights; for instance, and without limitation, liquid fill level indicator may illuminate green light when aerosolizable material reservoir is at full capacity and illuminate red light when aerosolizable material at low capacity. In other embodiments, active status indicator may also indicate, without limitation, a charging status of system 200; for instance, and without limitation, indicator light of active status indicator may emit light while system 200 is charging, and cease illumination when charging is complete. Indicator light of active status indicator may emit a first color of light while charging is occurring and a second when charging is complete, may blink to indicate charging is currently occurring, or the like. Any suitable pattern of illumination in response to charging status of system 200 may be used. In another non-limiting example, active status indicator may indicate device usability. Indicator light of active status indicator may emit, without limitation, color "green" when a control circuit is enabled, and color "red" when a control circuit is disabled.

Still referring to FIG. 2, additionally, or alternatively, a biometric reading window 224 may be located on outer body 208. As used in this disclosure, a "biometric reading window" is a designated area or surface on an outer body 208 where a biometric sensor is located or integrated. In a non-limiting example, biometric reading window 224 may be recessed into outer body 208, which may create a raised or flush surface. Biometric reading window 224 may enable user to interact with biometric sensor through outer body 208, allowing biometric sensor to capture and measure specific physiological or behavior characteristics of the user. In some cases, biometric sensor may include a fingerprint scanner, wherein the fingerprint scanner may be configured to capture at least a portion of user fingerprint (i.e., one or more unique patterns of ridges and valleys present on user's fingertip) to verify the user's identity and authenticate access to system 200. In some cases, the size of biometric reading window 224 may be sufficient to accommodate the specific biometric sensor being used. For example, and without limitation, fingerprint sensor may require a smaller window than a facial recognition sensor. In some cases, size and/or location of biometric reading window may be determined based on ergonomic requirements for ease of use and comfort during normal operation of system 200. In some cases, the surface of biometric reading window 224 may be smooth and free from any imperfections that might interfere with biometric sensor ability to capture accurate biometric data; for instance, and without limitation, surface of biometric reading window 224 may include an oleophobic coating (applied to the sensor surface to reduce the adhesion of oils, dirt, fingerprints, and/or the like). Additionally, or alternatively, biometric reading window 224 may be incorporated into other functional elements such as, without limitation, a power button, status indicator, or the like.

Figure 3A:
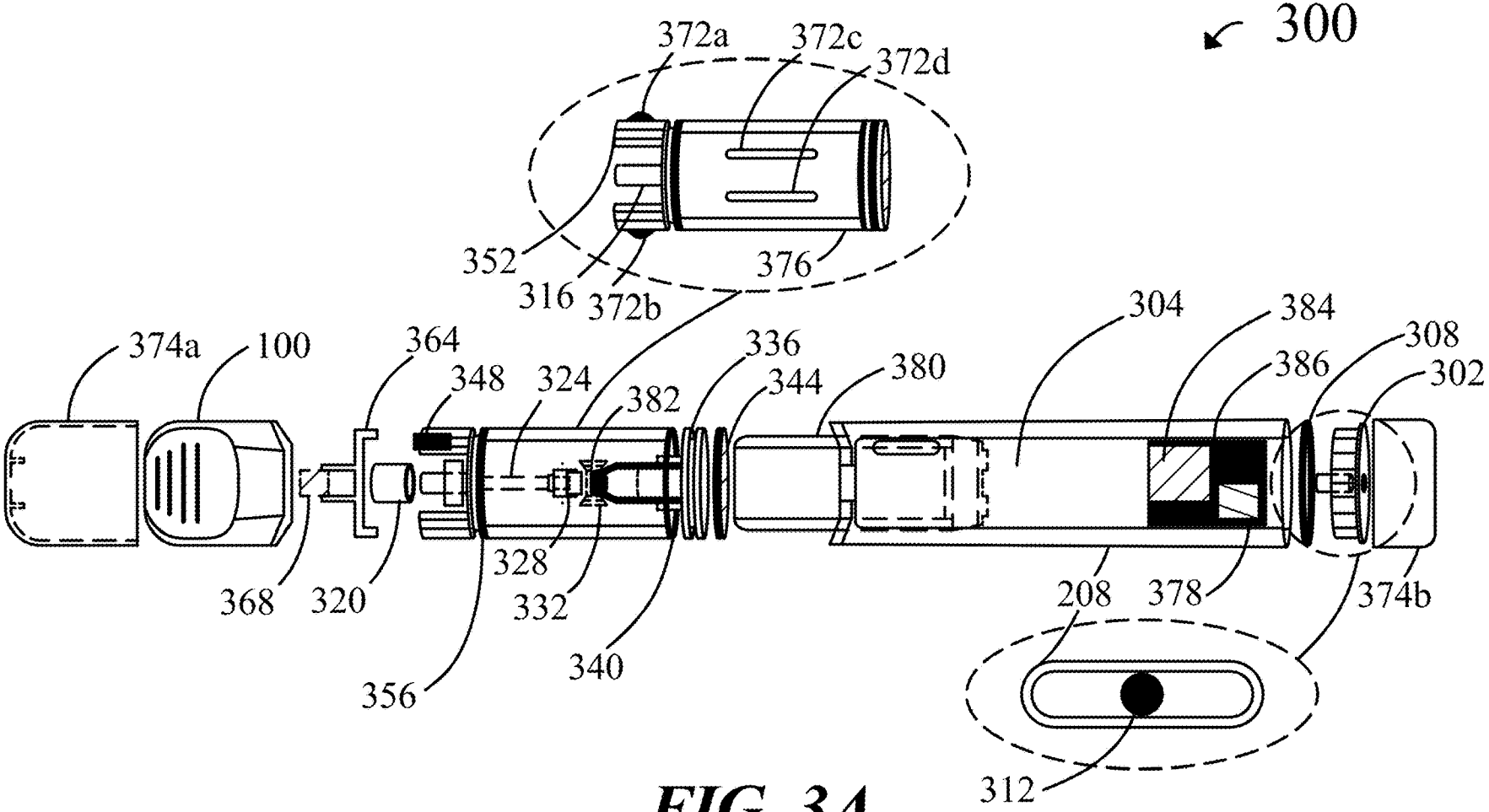
FIG. 3A depicts an explosion view of an exemplary system including an aerosol delivery device and a mouthpiece.

Referring now to FIG. 3A, an exemplary explosion view of system 200 is illustrated. System 200 may include outer body 208 as described above. In an embodiment, outer body 208 may be made of plastic, wherein the plastic may include eco-friendly, biodegradable, or otherwise compostable plastic. In a non-limiting example, such plastic may include plant-based plastic such as polylactic acid (PLA), polyhydroalkanoates (PHAs), polyhydroxy butyrate (PHB), Polyhdroxyvalerate (PHV), polyhydroxy hexanoate (PHH), and the like. In another non-limiting example, such plastic may include petroleum-based plastics such as polyglycolic acid (PGA), polybutylene succinate (PBS). Polycaprolactone (PCL), polybutylene adipate terephthalate (PBAT), Oxo-degradable polypropylene (oxo-PP), and the like. Other components of system 200 such as, without limitation, mouthpiece 100, cotton stand 364, reservoir 376, and end cap 304 may be made of such plastic as well. Further, pieces with more elasticity such as a reservoir plug or seals 348, 344 and 332 may be made of such plastic as well, as long as required elasticity requirements are made that are similar to certain types of silicone. In a non-limiting example, battery within outer body 208 may also be eco-friendly by implementing biodegradable electrolytes, as well as replacing non-biodegradable, petroleum-based polymers with those that can easily degrade, thereby minimizing the usage of non-renewable resources in power source 380. By removing metals, using biodegradable polymers, and implementing biodegradable electrolytes, batteries may become biodegradable themselves. However, even if power source 380 is a lithium-ion battery, a fully biodegradable plastic construction can allow the user to take out the battery of the device, recharge it, and reinsert it into a new body while composting or disposing of the old body. In this embodiment, the disposable unit would be biodegradable, and the battery would be recharged by the user and reinserted into a new disposable body. This construction, a form of a rechargeable disposable, may require a battery holder that is insertable into the body and protects the user from handling a battery directly. Further, this construction may have a pair of pins or another method of forming an electrical connection with the heating element upon insertion, rather than being soldered together. The user may also elect to dispose of an insertable battery separately in a battery recycling facility, while being able to through the biodegradable plastic unit away. Lastly, an embodiment of using biodegradable plastics described herein fits a cartridge/rechargeable battery model. If the mouthpiece were to be connected to the reservoir and aerosolization chamber, in the form of a cartridge, and that cartridge were to be insertable and detachable of the unit body containing a fixed and rechargeable battery, an electrical connection is required to form between the cartridge at insertion with the body. As the user can keep the rechargeable body but would need to continue to buy the disposable cartridges, a cartridge made entirely out of biodegradable plastics would assist the user in not having to recycle the disposable part but yet create a sustainable use for small disposable cartridges.

With continued reference to FIG. 3A, in some embodiments, outer body 208 may be constructed from an injectable mold. Outer body 208, mouthpiece 100, and/or components of system 200 may be manufactured using an injectable mold. Manufacturing outer body 208 may include using an injection molding process, wherein the injection molding process may involve a use of injectable mold configured to create specific shape and features of outer body 208. In some embodiments, injectable mold may include two halves that are clamped together, with one or more cavities in between, wherein the cavities may define the shape of outer body 208. In some cases, material such as, without limitation, BIOGRADE B-M (i.e., blend of thermoplastic starch (TPS), aliphatic polyesters (AP) and natural plasticizers (glycerol and sorbitol)) may be injected into the injectable mold under high pressure, filling the space and taking on the shape of injectable mold. Other exemplary materials may include, without limitation, BIOPAR FG MO (i.e., bio-plastic resin consisting mainly of thermoplastic potato starch, biodegradable synthetic copolyesters and additivies), BIOPLAST (i.e., new kind of plasticizer cherfreien thermoplastic material), ENSO RENEW RTP (i.e., renewable, biodegradable, compostable and economic thermoplastic), and/or the like. Injection molding process may include a cooling process which is configured to cool and/or solidify injected material. Injectable mold may be then opened and finished outer body 208 may be removed. In some cases, injectable mold may be precisely machined to desired shape and size of outer body 208.

With continued reference to FIG. 3A, outer body 208 may include printed circuit board (PCB) 386 containing near field communication (NFC) chip 378 connected with one or more antennas 384. One end of outer body 208 may be enclosed by a body base 304. As used in this disclosure, a "body base" is a chassis of an aerosol delivery device. In some cases, body base 304 may include a body base seal 308, wherein the body base seal 308 is a component that seals the connection between outer body 208 and body base 304, preventing leaks and ensuring proper functioning of system 200. In a non-limiting example, body base seal 308 may create a tight seal when pressed against front end of aerosol delivery device 204. In other cases, body base 304 may include a base plug 312 connected to PCB 386, wherein the base plug 312 may include, without limitation, a transmitter, a separate PCB, a pressure sensor, a light element, and/or the like; for instance, base plug 312 may include a separate PCB with integrated pressure sensor. For another instance, and without limitation, base plug 312 may also include a base light, wherein the base light may be consistent with a status indicator 220 as described above. Additionally, or alternatively, base plug 312 may include a lighting scheme, wherein the lighting scheme may include one or more openings that allow light to shine through. In some cases, lighting scheme may include an opening in a shape of a logo or a shape of an initial of company producing system 200.

With continued reference to FIG. 3A, mouthpiece 100 may fit into an opposite end of the end of aerosol delivery device 204 sealed by body base 304. In an embodiment, reservoir 376 and power source 380 (e.g., battery) may be placed within outer body 208, in between mouthpiece 100 and body base 304. In some cases, reservoir 376 may include a channel 316, wherein channel 316 is a pathway or a passage through which aerosolized material flows. Channel 316 may also be encased by a cotton absorption pad, centered around channel 316. Channel 316 may either be molded into the reservoir as an extension of a vapor tube 324 or may be separate components. Vapor tube 324 may either be molded as part of reservoir 376 or be made of a different material and inserted later on. Vapor tube 324's function may be to transport aerosolized material from heating chamber to user. In a non-limiting example, reservoir 376 may be in fluidic connection with heating element 382 such as, without limitation, a heating coil (i.e., a wire coil that heated to vaporize the aerosolizable material). A vapor channel seal 328 may be placed at the base of vapor tube 324 and encased the sides of heating element 382 to assist controlling of wicking and liquid flow into the heating chamber. A "vapor channel seal," as described herein, is a sealing component that ensures an airtight seal and leak-proof seal within vapor path or airway. In an embodiment, a vapor channel seal 328 may be around a coil assembly (heating element 382). A heating coil cotton 332 may be wrapped around or threaded through a heating coil, ensuring that the aerosolizable material comes into contact with the heated coil when apparatus is activated. Heating coil cotton 332 may absorb aerosolizable material, and as the heating coil heats up, vaporizing the aerosolizable material, which may be then inhaled by the user. In a non-limiting example, heating coil cotton 332 may include a wick. In some cases, vapor channel seal 328 may also be configured to perform the function of wicking/funneling control similar to heating coil cotton 332. Additionally, or alternatively, heating element 382, vapor channel seal 328, and heating coil cotton 332 may be disposed inside reservoir 376 isolated from aerosolizable material. Further, vapor channel seal 328 may serve as a seal with vapor tube; However, it also forms an aerosolization chamber when vapor channel seal 328 is inserted onto heating element 382 connected with the reservoir base 336 (i.e., liquid chamber deck).

Still referring to FIG. 3A, a reservoir base 336 may connect to reservoir 376. As used in this disclosure, a "reservoir base" refers to a base section of a reservoir which is connected to a heating element and allows the wicking material to absorb aerosolizable material and deliver it to a heating element for vaporization. In a non-limiting example, reservoir base 336 with or without heating element 382, vapor channel seal 328, and/or heating coil cotton 332 attached may be inserted into reservoir 376 in a direction consistent with body base 304, along with a reservoir base seal 340, wherein the reservoir base seal 340 serves to prevent aerosolizable material from leaking out of reservoir 376 onto reservoir base 336 or other internal components such as, without limitation, power source 380, PCB 386, and/or the like. Additionally, or alternatively, a reservoir battery seal 344 may be disposed in between reservoir 376 and power source 380 (i.e., under reservoir base 328 and above power source 380), wherein the reservoir battery seal 344 serve as a secondary protection for power source 380, preventing aerosolizable material from leaking out through reservoir base 336 into power source 380.

Still referring to FIG. 3A, reservoir 376 may include a reservoir fill port seal 348. In an embodiment, reservoir 376 may include a reservoir fill port 352, wherein the reservoir fill port 352 may include a small opening on reservoir 376 and/or outer body 208 of system 200 that allows user to fill reservoir 376 with user-preferred aerosolizable material. In some cases, reservoir fill port may be located on the top of reservoir 376 and covered by reservoir fill port seal 548. As described herein, a "reservoir fill port seal" is a seal that prevents aerosolizable material from leaking out of a reservoir fill port. In some cases, reservoir fill port seal 348 may include a removable cap or plug. Once reservoir 376 is filled, reservoir fill port seal 348 may be placed into reservoir fill port 352, sealing the reservoir fill port 352 and preventing e-liquid from leaking out. Reservoir 376 may further include a reservoir seal 356 disposed at the opposite end of reservoir base seal 340. In a non-limiting example, reservoir seal 356 may be placed around reservoir fill port seal 348 and reservoir fill port 352. Snapping of mouthpiece 100 onto reservoir 376 may allow for both airflow management and avoiding condensation to seep out by configuring an airtight seal on top of reservoir 376. Airtight sealing both on top of reservoir 376 through reservoir battery seal 344 and bottom through reservoir base seal 340 may improve stability of active ingredient filled in reservoir 376 as it avoids contact with air (i.e., potential oxidation).

Still referring to FIG. 3A, reservoir 376 may include a reservoir cotton 320 wrapped around the outlet of channel 316. As described herein, a "reservoir cotton" is a component configured to absorb any excess aerosolizable material may have been vaporized by a heating element but not inhaled by the user, preventing aerosolizable material from entering the user's mouth. Further, cotton stand 364 may also be mechanically connected to mouthpiece 100 and hold a further cotton such as, without limitation, a mouthpiece cotton 368. Mouthpiece cotton 368 may be fixed on top of cotton stand inside mouthpiece 100. In an embodiment, mouthpiece cotton 368 may be in contact with the outlet of mouthpiece 100 and may be used as a filter configured to help prevent aerosolizable material from entering the user's mouth. In some cases, mouthpiece cotton 368 may also help to reduce condensation and improve the overall vaping experience.

With continued reference to FIG. 3A, reservoir 376 may include a plurality of alignment features 372*a-d* on the exterior. As used in this disclosure, an "alignment feature" on the exterior of a reservoir is a physical feature that helps to precisely and securely align and/or fix the reservoir within an outer body. In a non-limiting example, reservoir 376 may be internally coupled to outer body 208 through plurality of alignment features 372*a-d*. In some cases, alignment feature may include one or more male alignment features 372*a-b*, wherein the male alignment features 372*a-b* may include physical features that projects outwardly from reservoir 376, while the female alignment features 372*c-d* may include corresponding physical feature that is recessed or indented into reservoir 376, designed to receive and align with male alignment features 372*a-b*. In a non-limiting example, reservoir 376 may be inserted into outer body 208 through press fit and/or snap fit. The interior of outer body may include a plurality of alignment features that match plurality of alignment features 372*a-d* on the reservoir 376. For instance, and without limitation, female alignment features 372*c-d* may include windows around reservoir 376, wherein these windows may be configured to fit plurality of male alignment features (e.g., bumps or protrusions) within outer body 208 at a desired location.

Additionally, or alternatively, and still referring to FIG. 3A, system 200 may include a top/bottom seal 374*a-b*, wherein the top/bottom seal 374*a-b*. Top seal 374*a* may be placed over (e.g., covering) the mouthpiece 100 while bottom seal 374*b* may be placed over end cap 302 and some portion of outer body 208 towards end cap 302. In some cases, during fluid e.g., air or vaporized aerosolizable material travel tight top/bottom seal 374*a-b*, such seal may help to stabilize the pressure changes and prevent any leakage that may occur. In an embodiment, one or more rubber extrusions/inserts (within top/bottom seal 374*a-b*) may help further create an airtight seal by inserting the extrusions/inserts into connecting components (e.g., mouthpiece 100, end cap 302, and/or the like).

Figure 3B:
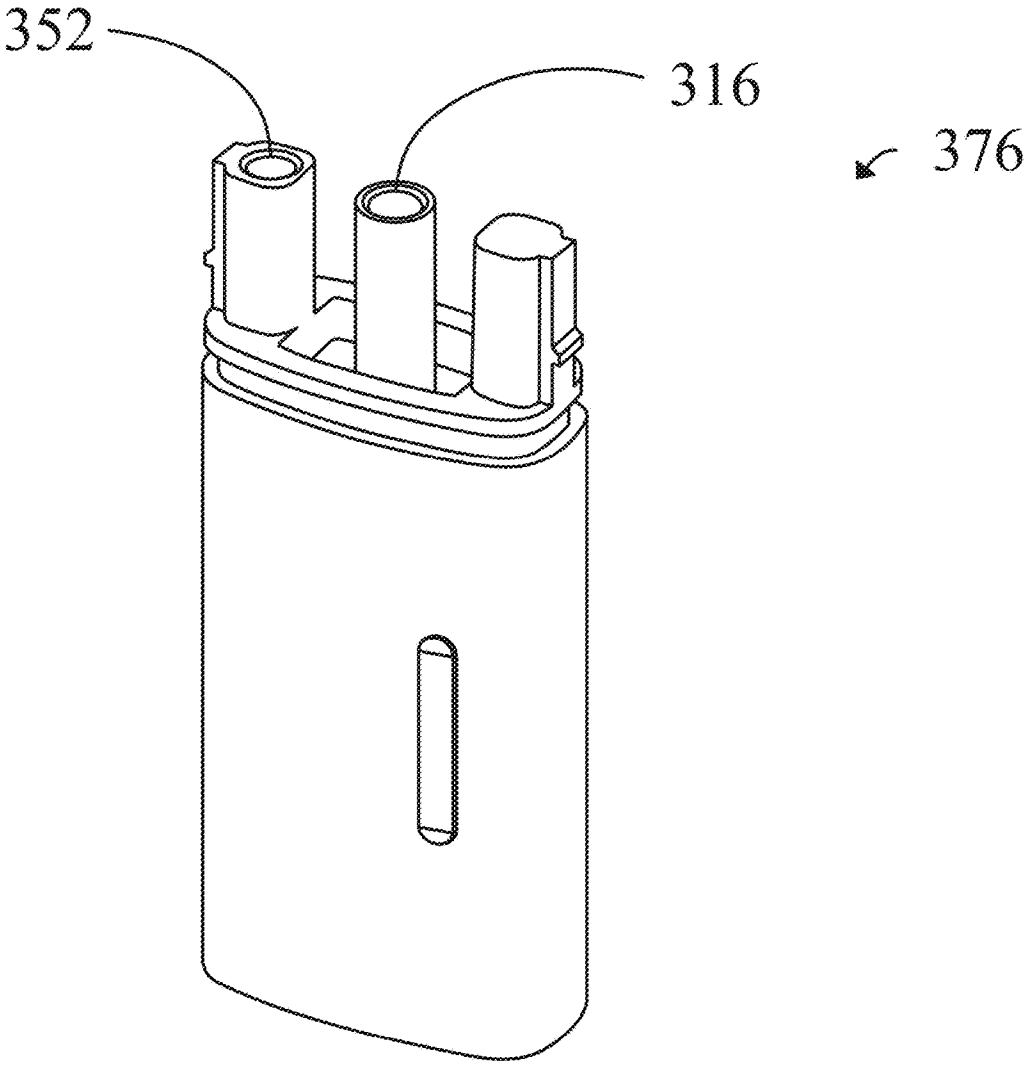
FIG. 3B depicts an exemplary reservoir.

Referring now to FIG. 3B, an exemplary embodiment of a reservoir 376 is illustrated. Reservoir 376 may include any reservoir described herein. Reservoir 376 may include reservoir fill port 352 and outlet of channel 316 as described above with reference to FIG. 3A. Reservoir 376 may be made of durable Poly Cyclohexylenedimethylene Terephthalate glycol-modified (PCTG) plastic as described above, resistant to impact, corrosion, and heat, ensuring that the content e.g., aerosolizable material will be purely the nicotine blend. It should also be noted that reservoir 376 may be fully recyclable.

Figure 3C:
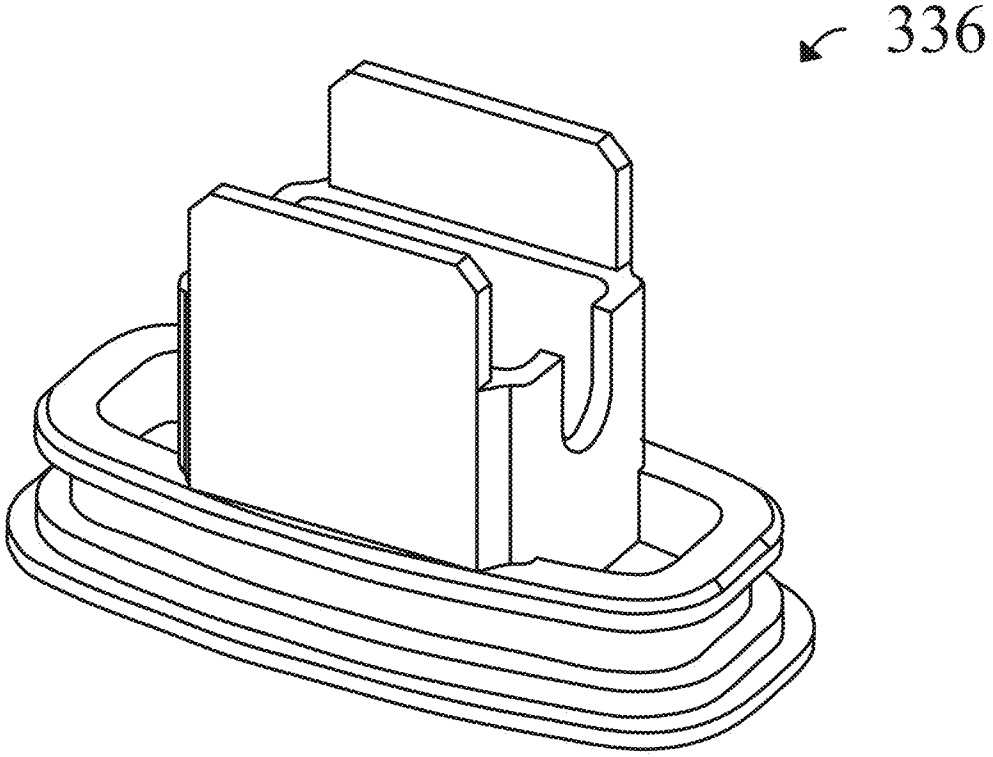
FIG. 3C depicts an exemplary reservoir base.

Referring now to FIG. 3C, an exemplary embodiment of a reservoir base 336 is illustrated. In some cases, reservoir base 336 may also be known as a liquid chamber deck attached to the bottom of reservoir 376 described herein. In some embodiments, reservoir base 336 may partition and tightly seal power source 380 away from reservoir 376 and heating element 382 e.g., heating coil, ensuring that vaporized aerosolizable material stays clean and pure, and power source 380 remains at a safe temperature. In some cases, reservoir base 336 may also be made of PCTG plastic as described above.

Figure 3D:
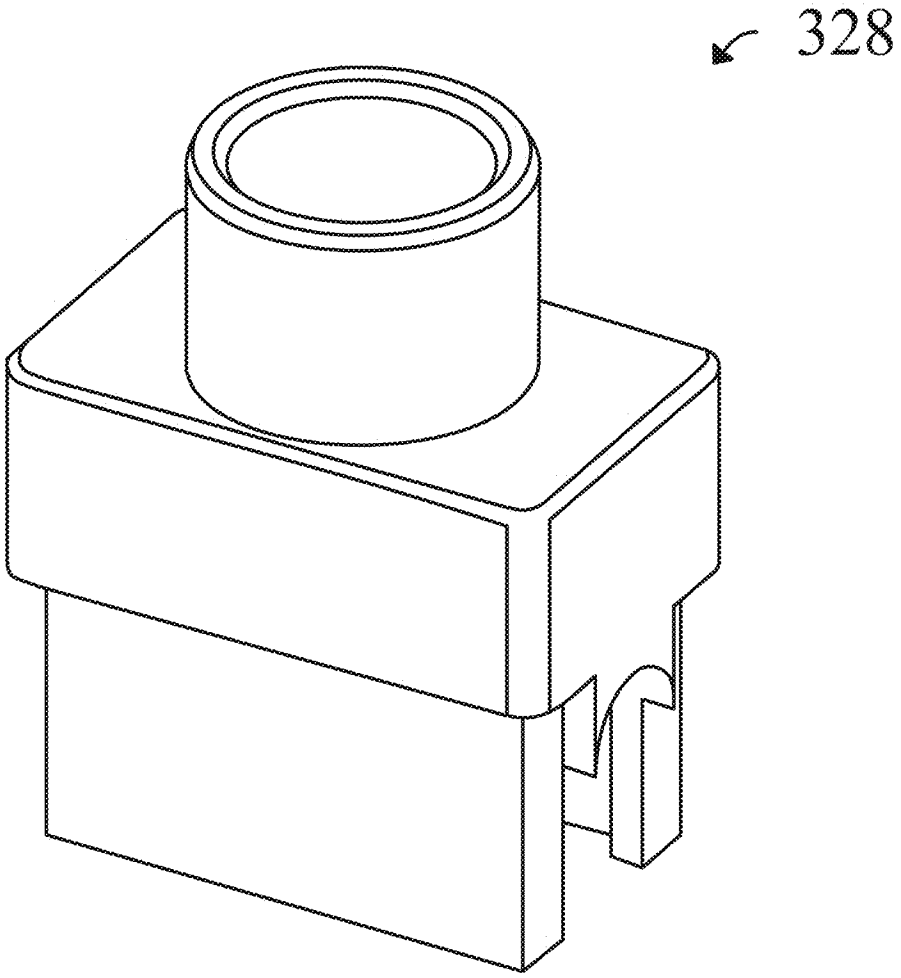
FIG. 3D depicts an exemplary vapor channel seal.

Referring now to FIG. 3D, an exemplary embodiment of vapor channel seal 328 is illustrated. In some cases, vapor channel seal 328 may include a heating chamber silicone, wherein the heating chamber silicone is where the vapor condenses. Such vapor channel seal 328 may be made of silicone rubber and may be recycled at a special silicone recycling facility. In some cases, vapor channel seal 328 may connect heating element 382 to vapor tube 324 as described above and rest, for example, and without limitation, on top of the center partition under reservoir 376.

Figure 3E:
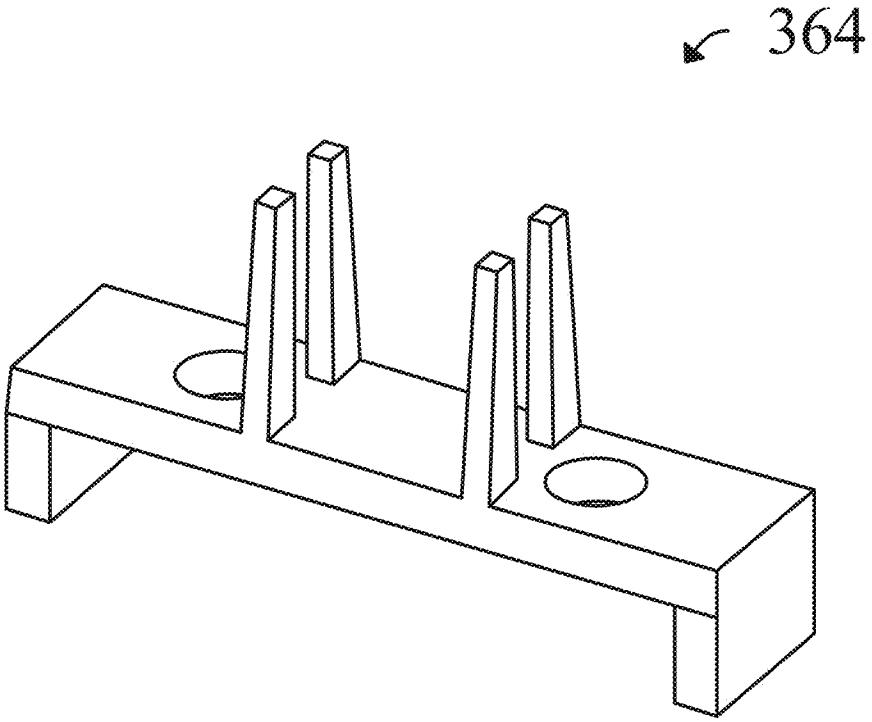
FIG. 3E depicts an exemplary cotton stand.

Referring now to FIG. 3E, an exemplary embodiment of cotton stand 364 is illustrated. In some cases, cotton stand 364 may be part of the fluid control mechanism as described above, wherein cotton stand 364 may be imperative in catching excess condensed vapor as it exists reservoir. In a non-limiting example, cotton stand 364 may include acrylonitrile butadiene styrene/Polycarbonate (ABS/PC) blend, which is a fully recyclable plastic. In some cases, cotton stand 364 may follow recycling code 7 for miscellaneous plastics.

Figure 4:
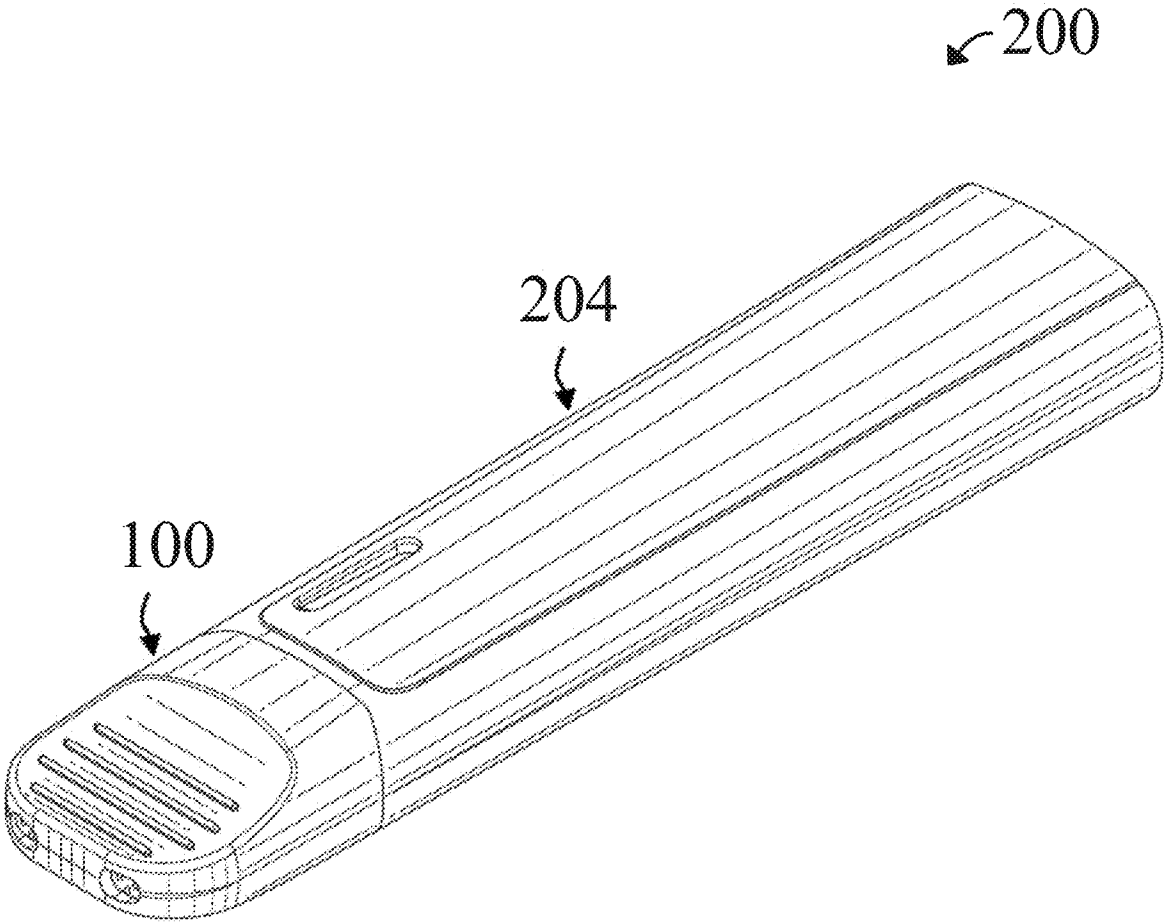
FIG. 4 depicts a side, back and front view of an exemplary system including an aerosol delivery device and a mouthpiece.

Now referring to FIG. 4, a top, back and side perspective view of system 200 including mouthpiece 100 and aerosol delivery device 204 is provided. While mouthpiece 100 is shown as attached to an aerosol delivery device 204, mouthpiece 100 may be implemented on other devices, such as pod systems, disposable ENDS, inhalers, nebulizers, and other oral drug delivery devices.

Still referring to FIG. 4, aerosol delivery device 204 may include a tank or chamber containing aerosols and/or oral medicine that will be vaporized; an atomizer or other heating element to generate heat for vaporization; a sensor and/or processor to detect use and enable power to the atomizer or other heating element; and/or a rechargeable battery for providing power to the atomizer or other heating element.

Now referring to FIGS. 4-10, varying views of system 200 are provided. FIG. 4 depicts a view from a perspective to the side, behind and above an exemplary system including an aerosol delivery device and a mouthpiece. System 200 may include mouthpiece 100 and aerosol delivery device 204.

Figure 5:
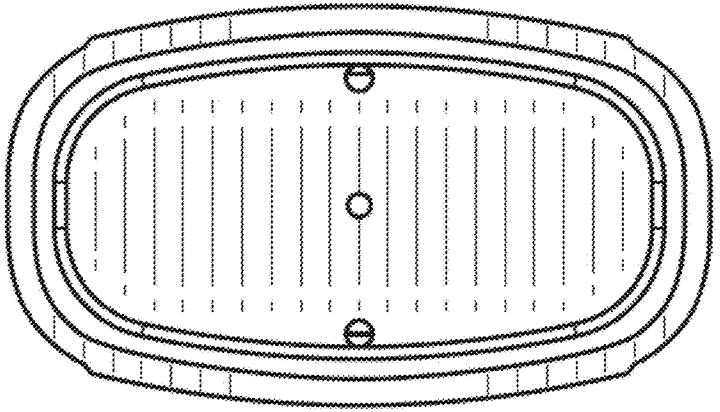
FIG. 5 depicts a front view of an exemplary aerosol delivery device.
Figure 6:
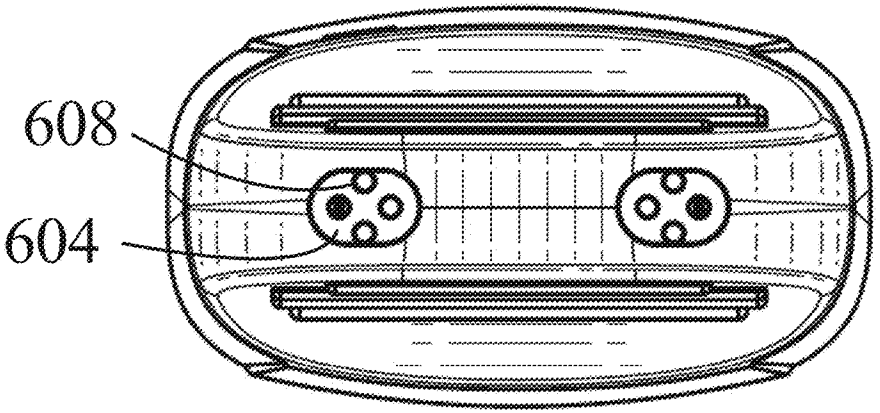
FIG. 6 depicts a rear view of an exemplary system including an aerosol delivery device and a mouthpiece.

Now referring to FIGS. 5 and 6, front and back views are provided. FIG. 5 depicts a front view of an exemplary aerosol delivery device. FIG. 6 depicts a rear view of an exemplary system including an aerosol delivery device and a mouthpiece. Mouthpiece 100 may include one or more apertures on aerosol release end 108. In some embodiments, an aperture may include a filter component 604. In some embodiments, a filter component may include one or more openings 608.

Figure 7:
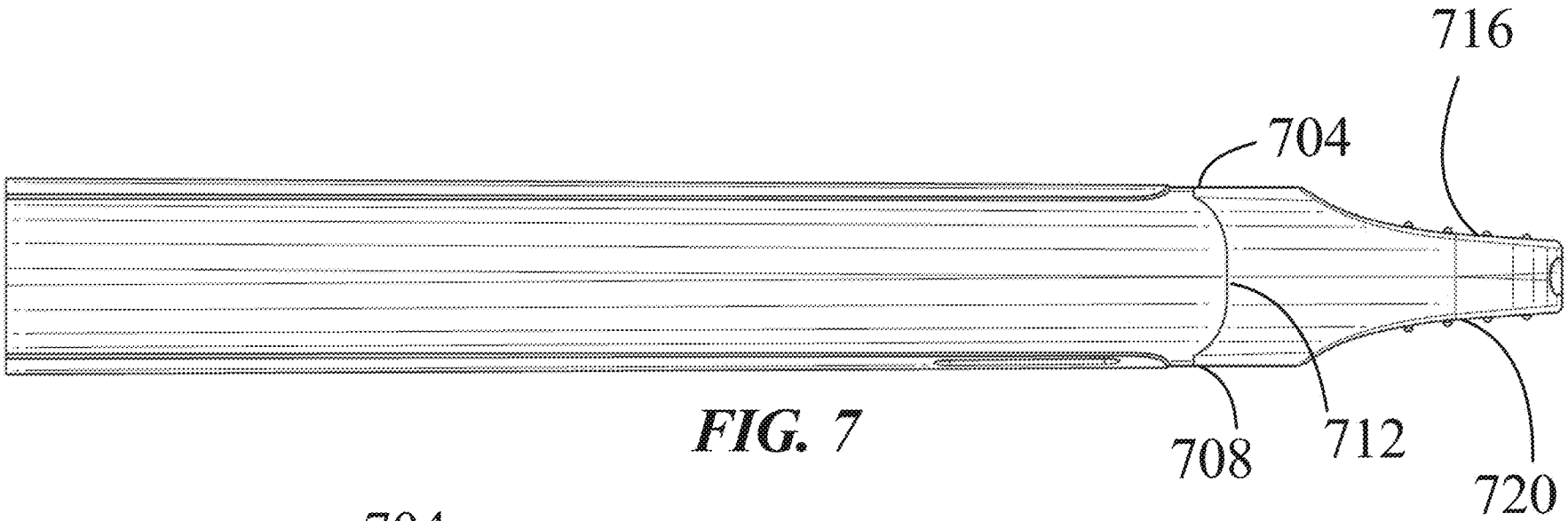
FIG. 7 depicts a left side view of an exemplary system including an aerosol delivery device and a mouthpiece.
Figure 8:
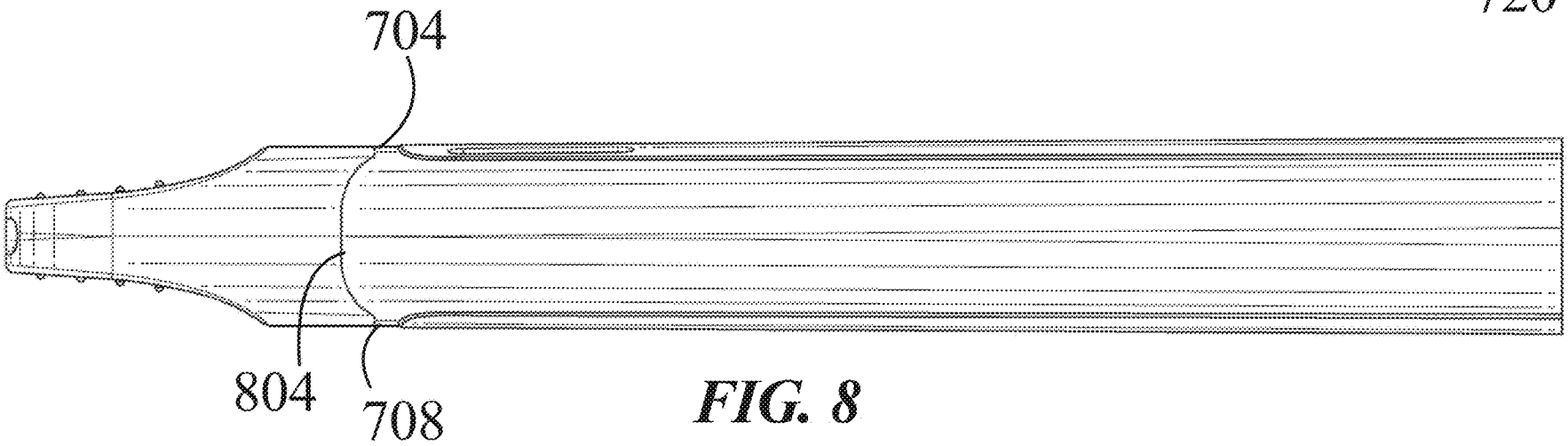
FIG. 8 depicts a right side view of an exemplary system including an aerosol delivery device and a mouthpiece.

Now referring to FIGS. 7 and 8, side views are provided. FIG. 7 depicts a left side view of an exemplary system including an aerosol delivery device and a mouthpiece. FIG. 8 depicts a right side view of an exemplary system including an aerosol delivery device and a mouthpiece. In some embodiments, aerosol delivery device attachment end 104 of mouthpiece 100 may include central top edge 704 parallel to a lateral axis of the mouthpiece, central bottom edge 708 parallel to a lateral axis of the mouthpiece, left side edge 712; and right side edge 804. In some embodiments, aerosol delivery device attachment end 104, central top edge 704 and central bottom edge 708 may each be forward of left side edge 712 and right side edge 804 along a longitudinal axis, except where the edges meet. In some embodiments, mouthpiece 100 may include a top surface 716 and a bottom surface 720. Top surface 716 and bottom surface 720 may be consistent with top surface and bottom surface described with reference to FIG. 1.

Figure 10:
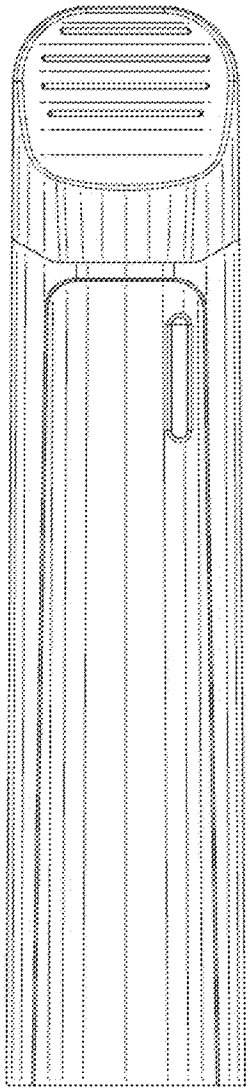
FIG. 10 depicts a bottom view of an exemplary system including an aerosol delivery device and a mouthpiece.
Figure 9:
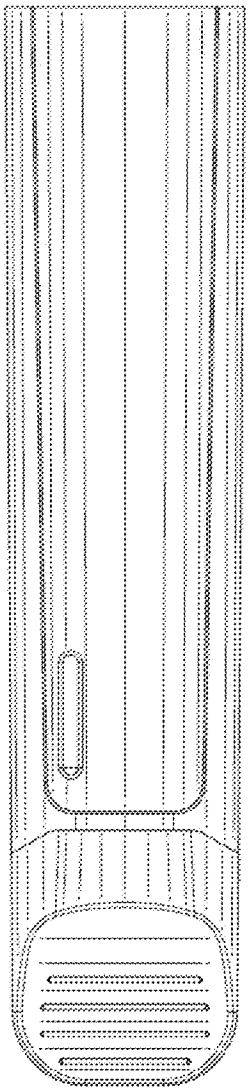
FIG. 9 depicts a top view of an exemplary system including an aerosol delivery device and a mouthpiece.

Now referring to FIGS. 9 and 10, side views are provided. FIG. 9 depicts a top view of an exemplary system including an aerosol delivery device and a mouthpiece. FIG. 10 depicts a bottom view of an exemplary system including an aerosol delivery device and a mouthpiece.

Figure 11:
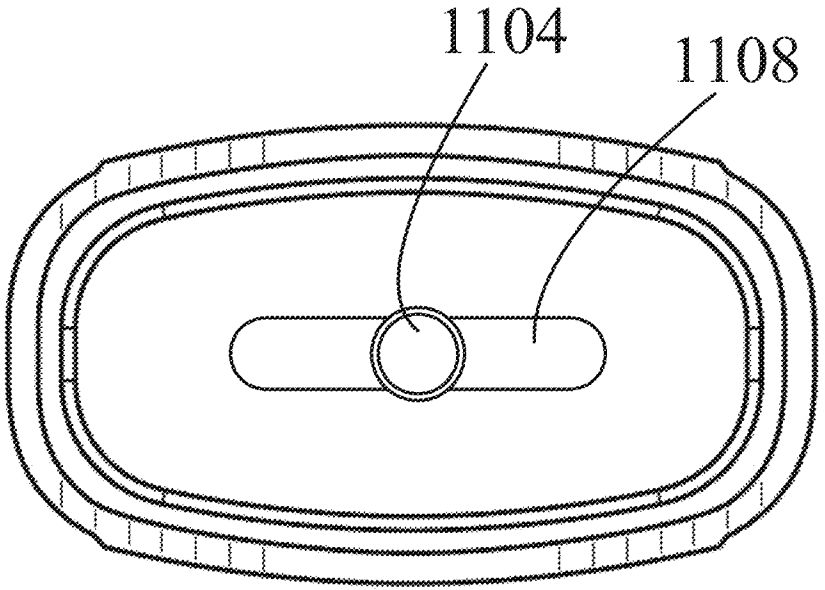
FIG. 11 depicts a front view of an exemplary mouthpiece.

Now referring to FIG. 11, a font view of an exemplary embodiment of mouthpiece 100 is provided. in some embodiments, mouthpiece 100 may include port 1104 which may connect to aerosol delivery device 204. In some embodiments, mouthpiece 100 may include channel 1108 which may connect port 1104 to first aperture 112 and/or second aperture 116. In some embodiments, user may draw aerosol from aerosol delivery device 204, through port 1104, channel 1108, and one or both of first aperture 112 and second aperture 116. Channel 1108 and port 1104 may be consistent with any channel and port (respectively) discussed with reference to FIG. 1.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., Compact Disc (CD), Compact Disc-recordable (CD-R), Digital Versatile Disc (DVD), Digital Versatile Disk-recordable (DVD-R), etc.), a magneto-optical disk, a read-only memory (ROM) device, a random access memory (RAM) device, a magnetic card, an optical card, a solid-state memory device, an Erasable Programmable Ready-Only Memory (EPROM), an Electronically Erasable Programmable Ready-Only Memory (EEPROM), and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instruction, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 12:
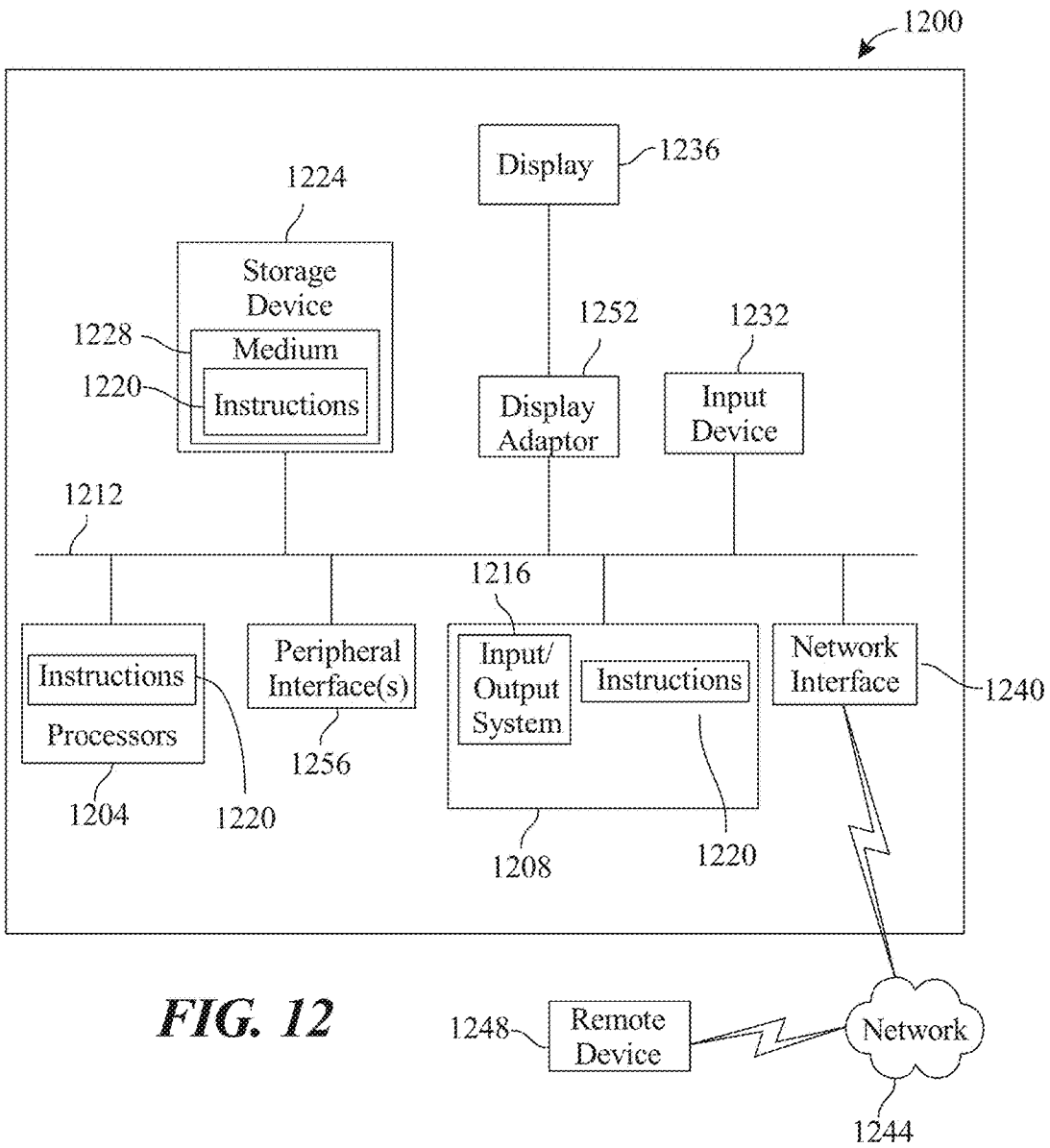
FIG. 12 is a block diagram of a computing system that can be used to implement any one or more of the methodologies disclosed herein and any one or more portions thereof.

FIG. 12 shows a diagrammatic representation of one embodiment of a computing device in the exemplary form of a computer system 1200 within which a set of instructions for causing a control system to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 1200 includes a processor 1204 and a memory 1208 that communicate with each other, and with other components, via a bus 1212. Bus 1212 may include any of several types of bus structures including, but not limited to, a memory bus, a memory controller, a peripheral bus, a local bus, and any combinations thereof, using any of a variety of bus architectures.

Processor 1204 may include any suitable processor, such as without limitation a processor incorporating logical circuitry for performing arithmetic and logical operations, such as an arithmetic and logic unit (ALU), which may be regulated with a state machine and directed by operational inputs from memory and/or sensors; processor 1204 may be organized according to Von Neumann and/or Harvard architecture as a non-limiting example. Processor 1204 may include, incorporate, and/or be incorporated in, without limitation, a microcontroller, microprocessor, digital signal processor (DSP), Field Programmable Gate Array (FPGA), Complex Programmable Logic Device (CPLD), Graphical Processing Unit (GPU), general purpose GPU, Tensor Processing Unit (TPU), analog or mixed signal processor, Trusted Platform Module (TPM), a floating point unit (FPU), and/or system on a chip (SoC).

Memory 1208 may include various components (e.g., machine-readable media) including, but not limited to, a random-access memory component, a read only component, and any combinations thereof. In one example, a basic input/output system 1216 (BIOS), including basic routines that help to transfer information between elements within computer system 1200, such as during start-up, may be stored in memory 1208. Memory 1208 may also include (e.g., stored on one or more machine-readable media) instructions (e.g., software) 1220 embodying any one or more of the aspects and/or methodologies of the present disclosure. In another example, memory 1208 may further include any number of program modules including, but not limited to, an operating system, one or more application programs, other program modules, program data, and any combinations thereof.

Computer system 1200 may also include a storage device 1224. Examples of a storage device (e.g., storage device 1224) include, but are not limited to, a hard disk drive, a magnetic disk drive, an optical disc drive in combination with an optical medium, a solid-state memory device, and any combinations thereof. Storage device 1224 may be connected to bus 1212 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 1224 (or one or more components thereof) may be removably interfaced with computer system 1200 (e.g., via an external port connector (not shown)). Particularly, storage device 1224 and an associated machine-readable medium 1228 may provide nonvolatile and/or volatile storage of machine-readable instructions, data structures, program modules, and/or other data for computer system 1200. In one example, software 1220 may reside, completely or partially, within machine-readable medium 1228. In another example, software 1220 may reside, completely or partially, within processor 1204.

Computer system 1200 may also include an input device 1232. In one example, a user of computer system 1200 may enter commands and/or other information into computer system 1200 via input device 1232. Examples of an input device 1232 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 1232 may be interfaced to bus 1212 via any of a variety of interfaces (not shown) including, but not limited to, a serial interface, a parallel interface, a game port, a USB interface, a FIREWIRE interface, a direct interface to bus 1212, and any combinations thereof. Input device 1232 may include a touch screen interface that may be a part of or separate from display 1236, discussed further below. Input device 1232 may be utilized as a user selection device for selecting one or more graphical representations in a graphical interface as described above.

A user may also input commands and/or other information to computer system 1200 via storage device 1224 (e.g., a removable disk drive, a flash drive, etc.) and/or network interface device 1240. A network interface device, such as network interface device 1240, may be utilized for connecting computer system 1200 to one or more of a variety of networks, such as network 1244, and one or more remote devices 1248 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 1244, may employ a wired and/or a wireless mode of communication. In general, any network topology may be used. Information (e.g., data, software 1220, etc.) may be communicated to and/or from computer system 1200 via network interface device 1240.

Computer system 1200 may further include a video display adapter 1252 for communicating a displayable image to a display device, such as display device 1236. Examples of a display device include, but are not limited to, a liquid crystal display (LCD), a cathode ray tube (CRT), a plasma display, a light emitting diode (LED) display, and any combinations thereof. Display adapter 1252 and display device 1236 may be utilized in combination with processor 1204 to provide graphical representations of aspects of the present disclosure. In addition to a display device, computer system 1200 may include one or more other peripheral output devices including, but not limited to, an audio speaker, a printer, and any combinations thereof. Such peripheral output devices may be connected to bus 1212 via a peripheral interface 1256. Examples of a peripheral interface include, but are not limited to, a serial port, a USB connection, a FIREWIRE connection, a parallel connection, and any combinations thereof.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve systems, methods, and devices according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A mouthpiece comprising:

an aerosol device attachment end configured to connect to an aerosol delivery device;

an aerosol release end positioned on an opposite side of the mouthpiece from the aerosol device attachment end, wherein the aerosol release end is configured to provide an aerosol to a user through one or more apertures within the aerosol release end, wherein the one or more apertures are recessed into the aerosol release end;

a top surface, wherein the top surface comprises a first concave gripping surface comprising one or more top ridges;

a bottom surface, wherein the bottom surface comprises a second concave gripping surface comprising one or more bottom ridges;

a cotton stand mechanically connected to the mouthpiece and holding a mouthpiece cotton, wherein the mouthpiece cotton is in communication with the one or more apertures of the mouthpiece and is used as a filter configured to prevent aerosolizable material from entering the user's mouth; and a top seal, wherein the top seal is configured to create an airtight seal on the mouthpiece.

2. The mouthpiece of claim 1, wherein the one or more apertures comprises a first aperture and a second aperture.

3. The mouthpiece of claim 1, wherein each of the one or more apertures comprises a filter component, wherein each filter component defines a plurality of openings.

4. The mouthpiece of claim 1, wherein:

the first concave gripping surface comprises a first smooth surface, wherein the first smooth surface is:

located forward of the one or more top ridges; and longer in a longitudinal direction than the distance between two adjacent ridges of the one or more top ridges; and the second concave gripping surface comprises a second smooth surface, wherein the second smooth surface is:

located forward of the one or more bottom ridges; and longer in the longitudinal direction than the distance between two adjacent ridges of the one or more bottom ridges.

5. The mouthpiece of claim 1, wherein:

a first distance between two adjacent ridges of the one or more top ridges is at least as long as a second distance between a top rearmost ridge of the one or more top ridges and the aerosol release end; and a third distance between two adjacent ridges of the one or more bottom ridges is at least as long as a fourth distance between a bottom rearmost ridge of the one or more bottom ridges and the aerosol release end.

6. The mouthpiece of claim 1, wherein:

the one or more top ridges of the first concave gripping surface are each parallel to a lateral axis of the mouthpiece; and the one or more bottom ridges of the second concave gripping surface are each parallel to the lateral axis of the mouthpiece.

7. The mouthpiece of claim 6, wherein:

the one or more top ridges comprise four ridges; and the one or more bottom ridges comprise four ridges.

8. The mouthpiece of claim 7, wherein:

the four ridges of the one or more top ridges comprises a rearmost top ridge;

the rearmost top ridge is the shortest ridge of the one or more top ridges;

the four ridges of the one or more bottom ridges comprises a rearmost bottom ridge; and the rearmost bottom ridge is the shortest ridge of the one or more bottom ridges.

9. The mouthpiece of claim 1, wherein the aerosol device attachment end comprises:

a central top edge parallel to a lateral axis of the mouthpiece;

a central bottom edge parallel to a lateral axis of the mouthpiece;

a left side edge; and a right side edge, wherein the central top edge and the central bottom edge are each forward of the left side edge and the right side edge along a longitudinal axis, except where the edges meet.

10. The mouthpiece of claim 1, wherein the mouthpiece comprises BPA-free polycarbonate.

11. A system for aerosol delivery comprising:

an aerosol delivery device; and a mouthpiece comprising:

an aerosol device attachment end configured to connect to the aerosol delivery device;

an aerosol release end positioned on an opposite side of the mouthpiece from the aerosol device attachment end, wherein the aerosol release end is configured to provide an aerosol to a user through one or more apertures within the aerosol release end, wherein the one or more apertures are recessed into the aerosol release end;

a top surface, wherein the top surface comprises a first concave gripping surface comprising one or more top ridges;

a bottom surface, wherein the bottom surface comprises a second concave gripping surface comprising one or more bottom ridges;

a cotton stand mechanically connected to the mouthpiece and holding a mouthpiece cotton, wherein the mouthpiece cotton is in communication with the one or more apertures of the mouthpiece and is used as a filter configured to prevent aerosolizable material from entering the user's mouth; and a top seal, wherein the top seal is configured to create an airtight seal on the mouthpiece.

12. The system of claim 11, wherein the one or more apertures comprises a first aperture and a second aperture.

13. The system of claim 11, wherein each of the one or more apertures comprises a filter component, wherein each filter component defines a plurality of openings.

14. The system of claim 11, wherein:

the first concave gripping surface comprises a first smooth surface, wherein the first smooth surface is:

located forward of the one or more top ridges; and longer in a longitudinal direction than the distance between two adjacent ridges of the one or more top ridges; and the second concave gripping surface comprises a second smooth surface, wherein the second smooth surface is:

located forward of the one or more bottom ridges; and longer in the longitudinal direction than the distance between two adjacent ridges of the one or more bottom ridges.

15. The system of claim 11, wherein:

a first distance between two adjacent ridges of the one or more top ridges is at least as long as a second distance between a top rearmost ridge of the one or more top ridges and the aerosol release end; and a third distance between two adjacent ridges of the one or more bottom ridges is at least as long as a fourth distance between a bottom rearmost ridge of the one or more bottom ridges and the aerosol release end.

16. The system of claim 11, wherein:

the one or more top ridges of the first concave gripping surface are each parallel to a lateral axis of the mouthpiece; and the one or more bottom ridges of the second concave gripping surface are each parallel to the lateral axis of the mouthpiece.

17. The system of claim 16, wherein:

the one or more top ridges comprise four ridges; and the one or more bottom ridges comprise four ridges.

18. The system of claim 17, wherein:

the four ridges of the one or more top ridges comprises a rearmost top ridge;

the rearmost top ridge is the shortest ridge of the one or more top ridges;

the four ridges of the one or more bottom ridges comprises a rearmost bottom ridge; and the rearmost bottom ridge is the shortest ridge of the one or more bottom ridges.

19. The system of claim 11, wherein the aerosol device attachment end comprises:

a central top edge parallel to a lateral axis of the mouthpiece;

a central bottom edge parallel to a lateral axis of the mouthpiece;

a left side edge; and a right side edge, wherein the central top edge and the central bottom edge are each forward of the left side edge and the right side edge along a longitudinal axis, except where the edges meet.

20. The system of claim 11, wherein the mouthpiece comprises BPA-free polycarbonate.

* * * * *